US005459665A

United States Patent [19]

Hikita et al.

[11] Patent Number: 5,459,665

[45] Date of Patent: Oct. 17, 1995

[54] TRANSPORTATION SYSTEM TRAFFIC CONTROLLING SYSTEM USING A NEURAL NETWORK

[75] Inventors: Shiro Hikita; Masafumi Iwata; Kiyotoshi Komaya; Masashi Asuka; Yukio Goto, all of Hyogo, Japan

[73] Assignee: Mitsubishi Denki Kabushiki Kaisha, Tokyo, Japan

[21] Appl. No.: 260,020

[22] Filed: Jun. 15, 1994

[30] Foreign Application Priority Data

| | | | |
|---|---|---|---|
| Jun. 22, 1993 | [JP] | Japan | 5-150412 |
| Mar. 24, 1994 | [JP] | Japan | 6-053620 |
| Jun. 7, 1994 | [JP] | Japan | 6-125368 |

[51] Int. Cl.[6] ..... B66B 1/20

[52] U.S. Cl. ..... 364/437; 187/393; 395/910

[58] Field of Search ..... 364/138, 436, 364/437; 395/903, 905, 910; 187/124, 391, 393

[56] References Cited

U.S. PATENT DOCUMENTS

| | | | |
|---|---|---|---|
| 4,612,624 | 9/1986 | Tsuji | 364/581 |
| 5,168,136 | 12/1992 | Thangavelu et al. | 187/130 |
| 5,229,559 | 7/1993 | Siikonen et al. | 187/124 |
| 5,250,766 | 10/1993 | Hikita et al. | 187/133 |
| 5,331,121 | 7/1994 | Tsuji | 187/124 |
| 5,354,957 | 10/1994 | Robertson | 187/247 |

FOREIGN PATENT DOCUMENTS

| | | | |
|---|---|---|---|
| 0090642 | 10/1983 | European Pat. Off. . | |
| 1-175381 | 11/1989 | Japan . | |
| 2-286581 | 11/1990 | Japan | 187/133 |
| 4-28681 | 1/1992 | Japan . | |
| 1484500 | 9/1977 | United Kingdom . | |
| 1502841 | 3/1978 | United Kingdom . | |
| 2086081 | 5/1982 | United Kingdom . | |
| 2129976 | 5/1984 | United Kingdom . | |

OTHER PUBLICATIONS

"Adaptive Optimal Elevator Group Control by Neural Networks" 1991 Annual Conference of Japanese Neural Network Society pp. 187–188.

*Primary Examiner*—Michael Zanelli

*Attorney, Agent, or Firm*—Wolf, Greenfield & Sacks

[57] ABSTRACT

A traffic volume estimating apparatus 1A estimates the traffic volumes of traffic apparatus, and a traffic flow presuming apparatus 1B presumes the traffic flows generating the estimated traffic volumes. A presumption function constructing apparatus 1C corrects the presumption functions of the traffic flow presuming apparatus 1B on actually measured traffic volumes, traffic flow presumption results and control results. A control result detecting apparatus 1G detects the control results and the drive results of the traffic apparatus. Further, a control parameter setting apparatus 1D sets control parameters on traffic flow presumption results, and corrects the control parameters according to the control results and the drive results.

25 Claims, 19 Drawing Sheets

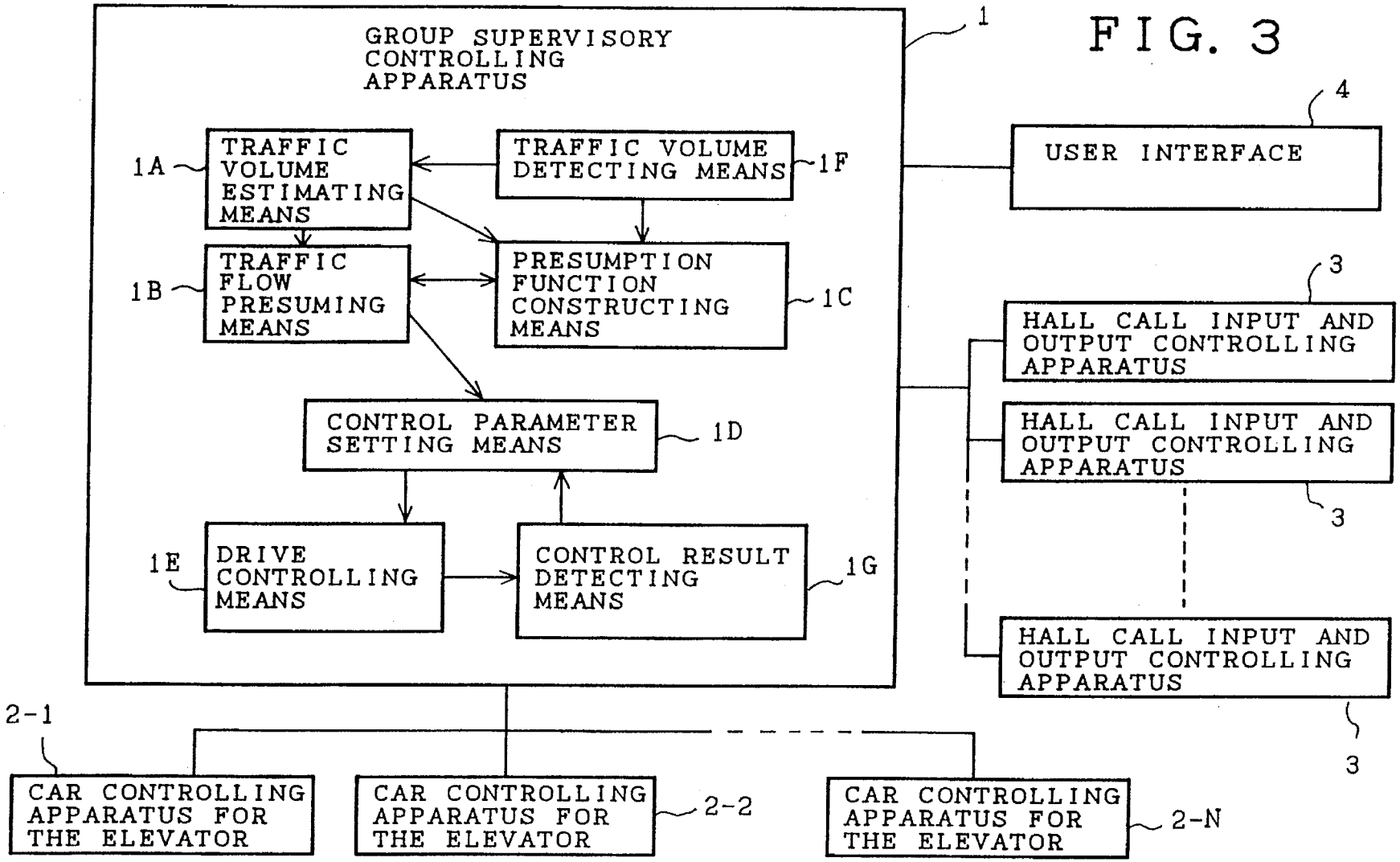
FIG. 3
1
GROUP SUPERVISORY CONTROLLING APPARATUS
4
USER INTERFACE
3
HALL CALL INPUT AND OUTPUT CONTROLLING APPARATUS
3
HALL CALL INPUT AND OUTPUT CONTROLLING APPARATUS
3
HALL CALL INPUT AND OUTPUT CONTROLLING APPARATUS
1F
TRAFFIC VOLUME DETECTING MEANS
1C
PRESUMPTION FUNCTION CONSTRUCTING MEANS
1D
CONTROL PARAMETER SETTING MEANS
1G
CONTROL RESULT DETECTING MEANS
1A
TRAFFIC VOLUME ESTIMATING MEANS
1B
TRAFFIC FLOW PRESUMING MEANS
1E
DRIVE CONTROLLING MEANS
2-1
CAR CONTROLLING APPARATUS FOR THE ELEVATOR
2-2
CAR CONTROLLING APPARATUS FOR THE ELEVATOR
2-N
CAR CONTROLLING APPARATUS FOR THE ELEVATOR

TRANSPORTATION SYSTEM TRAFFIC CONTROLLING SYSTEM USING A NEURAL NETWORK

BACKGROUND OF THE INVENTION

1. Field of the Invention

This invention relates to a traffic means controlling apparatus controlling traffic means like elevators, traffic means in road traffic or railways and the like.

2. Description of the Prior Art

In general, in case of controlling such traffic means as elevators, traffic means in road traffic or rail ways, the group controlling system totally controlling elevator cars or vehicles is applied. For example, in the case where plural elevators are juxtaposed, traffic service in a building is improved by means of practicing the group control (especially called as "group supervisory control" in case of elevator systems), in which generated hall calls are watched on-line at first, and suitable elevators are selected under the consideration of service states in the building totally, and then the elevators are assigned to the generated hall calls.

In such group supervisory control, it is desirable to be able to accurately grasp traffic flows, which contain elements indicating the quantities, the time and the directions of passengers' movements and to be able to estimate in advance. The movements of passengers include, for example, which time intervals passengers arrive at each hall in and which floor the passengers who rode on move to.

However, observable data on elevator traffic are limited to data indicating traffic volumes (hereinafter referred to as "traffic volume data") and the like, for example the number of passengers getting on and off elevators in a prescribed time zone, owing to the limitation of the hardware of used computers mainly, and consequently, the traffic flows which can be estimated on the basis of these traffic volume data are also made to be limited.

Traffic means controlling methods controlling traffic means in accordance with the characteristics of traffic volumes extracted from observed traffic volume data were proposed as resolving means for such the problem (for example, Japanese Unexamined Patent Publication No. Sho 59-22870) heretofore.

FIG. 1 is a block diagram showing a conventional elevator group supervisory control system. In FIG. 1, reference numeral 100 designates a group supervisory controlling apparatus executing the group supervisory control, the apparatus comprising a traffic volume detecting means 1F detecting traffic volumes, a traffic volume estimating means 100A estimating traffic volumes in prescribed time zones by practicing statistical treatment on the traffic volume data detected by the traffic volume detecting means 1F for several days, a traffic volume characteristic extracting means 100B extracting traffic volume characteristics in accordance with the estimated results by the traffic volume estimating means 100A, a control parameter setting means 100D setting parameters for the group supervisory control in accordance with the traffic volume characteristics extracted by the traffic volume characteristic extracting means 100B, and a drive controlling means 1E executing the drive control of each cars of elevators on the basis of the parameters set by the control parameter setting means 100D. Reference numerals 2-1 through 2-N designate car controlling apparatus respectively installed in each car (the 1st car to the Nth car) transporting passengers; numeral 3 designates hall call input and output controlling apparatus installed in each elevator hall and executing the inputting and outputting of hall calls; and numeral 4 designates a user interface for executing the setting or the changing of the control parameters from the outside.

Next, the operation will be described thereof.

At first, the traffic volume detecting means 1F detects calls at halls, passengers' getting on or off the elevators, or the like by monitoring them through each hall call input and output controlling apparatus 3 and car controlling apparatus 2-1–2-N while elevators are being driven, and the detecting means 1F inputs the detected traffic volume data into the traffic volume estimating means 100A. The traffic volume estimating means 100A estimates the traffic volumes at the prescribed time zones on the day when the control is practiced by statistically treating the traffic volume data detected by the traffic volume detecting means 1F, and the traffic volume estimating means 100A inputs the estimated traffic volumes into the traffic volume characteristic extracting means 100B. The traffic volume characteristic extracting means 100B extracts the characteristics of the traffic volumes from the estimated results of the traffic volume estimating means 100A by obtaining the degrees of the congestion of specific floors and the like, and the traffic volume characteristic extracting means 100B inputs the extracted characteristics into the control parameter setting means 100D. The control parameter setting means 100D sets the group supervisory control parameters in accordance with the characteristics extracted by the traffic volume characteristic extracting means 100B, and the control parameter setting means 100D inputs the set group supervisory control parameters into the drive controlling means 1E. The drive controlling means 1E controls the car controlling apparatus 2-1–2-N on the basis of the group supervisory control parameters set by the control parameter setting means 100D for executing the drive control of each car of the elevators. When a manager of the elevators changes controlling conditions and the like, he or she sets or changes the control parameters with the user interface 4.

The conventional traffic means controlling apparatus is constructed as described above, and it extracts the characteristics of the traffic volumes by obtaining the degrees of the congestion of specific floors and the like, and it sets the control parameters in accordance with the extracted traffic volume characteristics, and further it executes the group supervisory control on the basis of with the control parameters. Consequently, for example, even if the characteristics of the traffic volumes such as the degree of the congestion of a specific floor and the like are known, it is required to execute different controls between the state where passengers having gotten on the elevator at a certain floor dispersedly move to other floors equally and the state where the passengers concentratedly move to a specific floor, but it is difficult for the conventional traffic means controlling apparatus to distinguish these states and to control the elevators efficiently.

Besides, signal control at the intersections of roads or train group control in railways is conventionally controlled on the basis of the traffic volumes or their characteristics, which are only quantitative information heretofore, then it is difficult to control the signals or the train groups efficiently similarly.

Furthermore, control parameters can be set or changed by a manager (user) with the user interface 4 of the conventional traffic means controlling apparatus, but the manager can not refer the results of controlling or the results of driving after controlling the drive of the conventional apparatus, and consequently, the manager can not grasp how to change the control parameters for executing the efficient control, then the conventional traffic means controlling apparatus has a problem that it cannot lead out appropriate control parameters efficiently.

Furthermore, the estimation of traffic volumes is conventionally obtained by statistically treating past traffic volumes, for example by calculating the weighted averages of the traffic volumes at the same time zones for past several days. However, for example, there can be some differences in the beginning and ending times of rush hours or passenger numbers on days even in the same building, and consequently, errors happen in the estimated traffic volumes, then errors also happen in the traffic flows presumed from the past traffic volumes in the conventional traffic means controlling apparatus.

SUMMARY OF THE INVENTION

In view of the foregoing, it is an object of the present invention to provide a traffic means controlling apparatus which can recognize not only the quantities but also the movement directions, as traffic flows, of the movement states of passengers from traffic volumes, and which can presume the traffic flows more accurately, and further which can set and correct appropriate control parameters in accordance with the presumed traffic flows, then which can control traffic means efficiently.

It is another object of the present invention to provide a traffic means controlling apparatus which can presume traffic flows without requiring complicated logical operations and operational processings.

It is a further object of the present invention to provide a traffic means controlling apparatus which can presume traffic flows corresponding to inputted traffic volumes more accurately.

It is a further object of the present invention to provide a traffic means controlling apparatus which can always keep the presumption accuracy of traffic flow presuming functions good.

It is a further object of the present invention to provide a traffic means controlling apparatus which can easily detect the traffic flow pattern having the highest similarity from output values of plural neural networks.

It is a further object of the present invention to provide a traffic means controlling apparatus which can further improve its traffic flow estimating function.

It is a further object of the present invention to provide a traffic means controlling apparatus which can set values with which the most suitable control result can be obtained as control parameters for controlling traffic means.

It is a further object of the present invention to provide a traffic means controlling apparatus which can correct control parameters according to individual time zones even if errors between actual passengers' movements and presumed traffic flows happen at the individual time zones, and which can obtain further more suitable control results as the control of traffic means.

It is a further object of the present invention to provide a traffic means controlling apparatus which can correct control parameters in response to errors which would happen between actual passengers' movements and presumed traffic flows over all time zones, and which can obtain further more suitable control results as the control of traffic means.

It is a further object of the present invention to provide a traffic means controlling apparatus where managers can lead out and set appropriate control parameters efficiently.

It is a further object of the present invention to provide a traffic means controlling apparatus which can presume traffic flows on the basis of traffic volume data having better estimation accuracy.

According to the first aspect of the present invention, for achieving the above-mentioned objects, there is provided a traffic means controlling apparatus comprising a traffic flow presuming means presuming traffic flows from the traffic volumes detected by a traffic volume detecting means, a control parameter setting means setting control parameters in accordance with the traffic flows presumed by the traffic flow presuming means, and a presumption function constructing means constructing or correcting the presumption function of the traffic flow presuming means.

As stated above, the traffic means controlling apparatus according to the first aspect of the present invention presumes traffic flows from traffic volumes with the traffic flow presuming means, and constructs or corrects the traffic flow presuming function of the traffic flow presuming means with the presumption function constructing means, and further sets the control parameters for controlling traffic means in accordance with the presumed traffic flows with the control parameter setting means. Consequently, the movement states of passengers including moving directions can be recognized from traffic volumes, then traffic flows can be presumed more accurately. Further, appropriate control parameters can be set or corrected, then traffic means can be efficiently controlled.

According to the second aspect of the present invention, there is provided a traffic means controlling apparatus equipped with a neural network in its traffic flow presuming means.

As stated above, the traffic means controlling apparatus according to the second aspect of the present invention is provided with the neural network which operates the relationships between traffic volumes and traffic flows, and the traffic means controlling apparatus presumes the traffic flows from the traffic volumes, and consequently, the traffic flows can be presumed without complicated logical operations or arithmetic processings.

According to the third aspect of the present invention, there is provided a traffic means controlling apparatus the presumption function constructing means of which constructs a neural network by making it learn arbitrarily selected plural relationships among many relationships between traffic flow patterns and traffic volumes, and the presumption function constructing means of which corrects the neural network by making it re-learn newly selected relationships between traffic flow patterns and traffic volumes on the basis of the traffic flows presumed from actually measured traffic volumes and their controlled results.

As stated above, the traffic means controlling apparatus according to the third aspect of the present invention constructs and corrects the presuming function of the traffic flow presuming means by constructing an appropriate neural network by making it learn the arbitrarily selected plural relationships among many relationships between traffic flow patterns and traffic volumes with the presumption function constructing means, and by correcting the neural network by making it re-learn the information of the newly selected relationships between traffic flow patterns and traffic volumes on the basis of the traffic flows presumed from actually measured traffic volumes and their controlled results with the presumption function constructing means. Consequently, the traffic means controlling apparatus can presume the traffic flows corresponding to inputted traffic volumes more accurately. According to the fourth aspect of the present invention, there is provided a traffic means controlling apparatus the traffic flow presuming means of which has a neural network for control operating relationships between traffic volumes and traffic flows usually and a neural network for backup operating the relationships periodically, and the presumption function constructing means of which compares and evaluates the neural network for control and the neural network for backup to replace the contents of the neural network for control with the contents of the neural network for backup or to duplicate the latter to the former when the operated results of the neural network for backup are superior to the operated results of the neural network for control.

As stated above, the traffic means controlling apparatus according to the fourth aspect of the present invention presumes traffic flows for daily traffic means control with the neural network for control and presumes traffic flows periodically with the neural network for backup, and the traffic means controlling apparatus compares and evaluates the presumption results of the traffic flows of the two kinds of neural networks with the presumption function constructing means to correct the neural network for control by replacing the contents of the neural network for control with the contents of the neural network for backup or by duplicating the latter to the former when the presumed results of the neural network for backup are determined to be superior to the presumed results of the neural network for control. Consequently, the traffic means controlling apparatus can always keep the presumption accuracy of the traffic flow presuming function good.

According to the fifth aspect of the present invention, there is provided a traffic means controlling apparatus the traffic flow presuming means of which comprises a traffic flow distinguishing part distinguishing the traffic flows corresponding to traffic volumes from the traffic volumes with a neural network, and a traffic flow presuming part presuming traffic flow patterns by filtering the traffic flows distinguished by the traffic flow distinguishing part.

As stated above, the traffic means controlling apparatus according to the fifth aspect of the present invention presumes the traffic flow patterns from the output values of the neural network of the traffic flow distinguishing part by filtering the output values, and consequently, the traffic flow pattern having the highest similarity is easily detected out of plural neural network output values.

According to the sixth aspect of the present invention, there is provided a traffic means controlling apparatus the traffic flow presuming means of which further comprises an additional filtering function part complementing the filtering function.

As stated above, the traffic means controlling apparatus according to the sixth aspect of the present invention presumes traffic flow patterns from the output values of the neural network of the traffic flow distinguishing part by the use of the additional function in the filtering of the output values of the neural network, and consequently, the traffic flow presuming function is further improved.

According to the seventh aspect of the present invention, there is provided a traffic means controlling apparatus further comprising a control result detecting means detecting control results showing the controlled states by traffic means and drive results showing the actions of the traffic means.

As stated above, the traffic means controlling apparatus according to the seventh aspect of the present invention detects control results showing the controlled states by traffic means and drive results showing the actions of the traffic means with the control result detecting means, and consequently, the traffic means controlling apparatus can set values with which the most suitable control result can be obtained as control parameters for controlling traffic means.

According to the eighth aspect of the present invention, there is provided a traffic means controlling apparatus corrects control parameters by setting the standard values of the control parameters in accordance with traffic flows presumed by a traffic flow presuming means with a control parameter setting means, and by executing off-line tuning on the basis of control results and drive results detected by a control result detecting means.

As stated above, the traffic means controlling apparatus according to the eighth aspect of the present invention corrects the standard values of control parameters by setting the standard values in accordance with traffic flows presumed by the traffic flow presuming means with the control parameter setting means, and by executing off-line tuning on the basis of control results and drive results detected by the control result detecting means, and consequently, the traffic means controlling apparatus can correct the control parameters according to individual time zones even if errors between the actual movements of passengers or the like and the presumed traffic flows happen at the individual time zones, and it can obtain further more suitable control results as the control of traffic means.

According to the ninth aspect of the present invention, there is provided a traffic means controlling apparatus corrects control parameters by detecting control results or drive results in real time with a control result detecting means, and by setting the standard values of control parameters on the basis of presumed traffic flows by a traffic flow presuming means with a control parameter setting means, and further by executing on-line tuning in accordance with the control results or the drive results detected by the control result detecting means with the control parameter setting means.

As stated above, the traffic means controlling apparatus according to the ninth aspect of the present invention corrects control parameters by detecting control results or drive results in real time with the control result detecting means, and by setting the standard values of control parameters on the basis of presumed traffic flows by the traffic flow presuming means with the control parameter setting means, and further by executing on-line tuning in accordance with the control results or the drive results detected by the control result detecting means with the control parameter setting means, and consequently, the traffic means controlling apparatus can correct control parameters in response to errors which would happen between the actual movements of passengers or the like and presumed traffic flows over all time zones, and it can obtain further more suitable control results as the control of traffic means.

According to the tenth aspect of the present invention, there is provided a traffic means controlling apparatus further comprising a user interface which outputs control results and drive results detected by a control result detecting means and sets or corrects control parameters in response to the directions of a manager.

As stated above, the traffic means controlling apparatus according to the tenth aspect of the present invention outputs control results and drive results detected by the control result detecting means to a manager and sets or corrects control parameters in response to the directions of the manager with the user interface, and consequently, the managers can lead out and set appropriate control parameters efficiently.

According to the eleventh aspect of the present invention, there is provided a traffic means controlling apparatus further comprising a traffic volume estimating means estimating traffic volumes during prescribed time zones from traffic volumes, the traffic volume estimating means estimating the traffic volumes from the time points of traffic volume detection by a traffic volume detecting means in real time by executing the sampling processing of the traffic volumes detected by the traffic volume detecting means in real time on the day of controlling.

As stated above, the traffic means controlling apparatus according to the eleventh aspect of the present invention estimates traffic volumes from the time points of traffic volume detection in real time by executing the sampling processing of the traffic volumes detected in real time, and consequently, it can presume traffic flows on the basis of traffic volume data having better estimation accuracy.

The above and further objects and novel features of the present invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 3 is a block diagram showing the construction of the embodiment 1 of the present invention;

DETAILED DESCRIPTION OF THE PREFERRED EMBODIMENTS

Preferred embodiments of the present invention will now be described in detail with reference made to the accompanying drawings.

Figure 1:
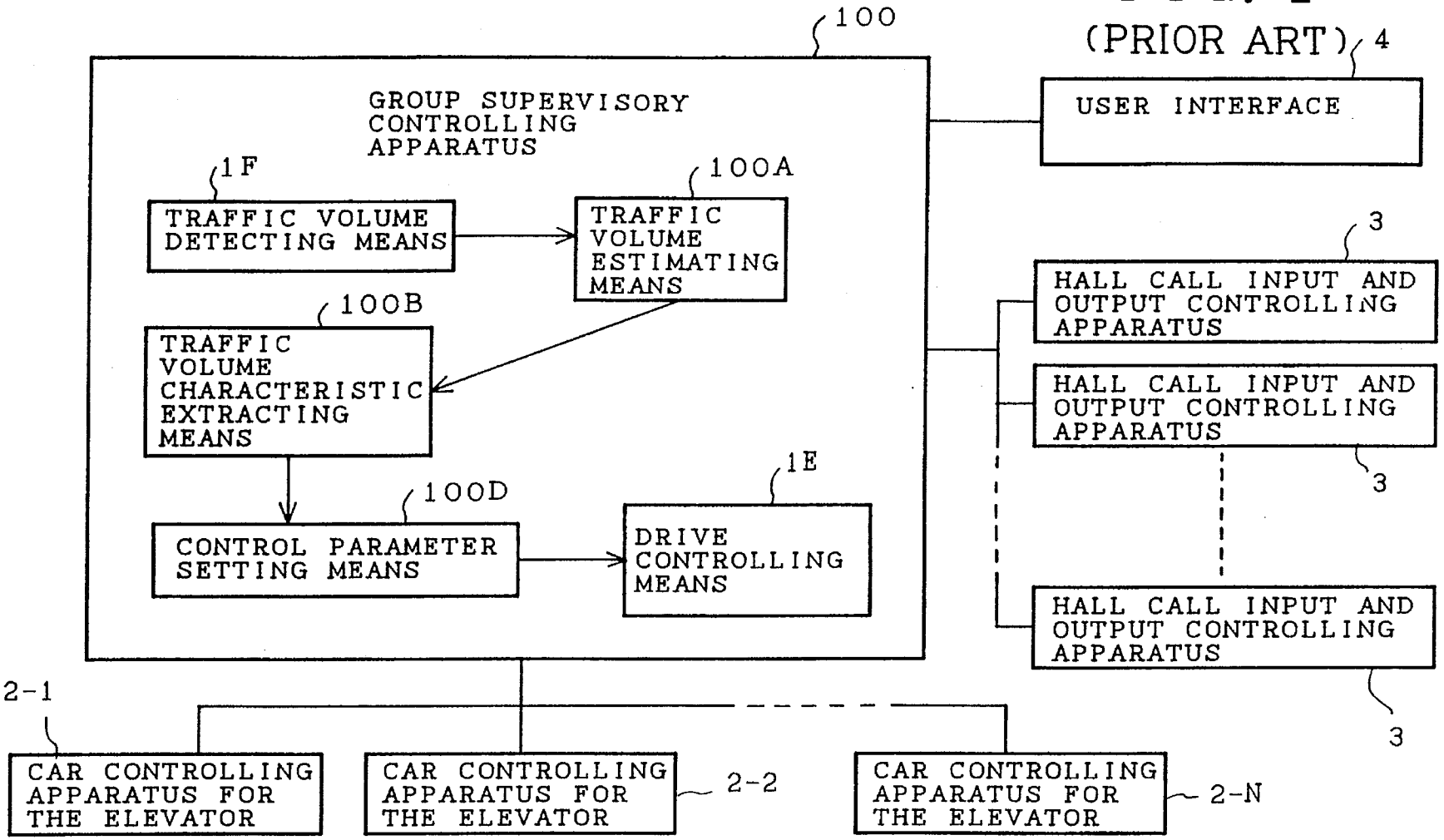
FIG. 1 (PRIOR ART)
FIG. 1 is a block diagram showing an example of constructions of conventional traffic means controlling apparatus.
Figure 2:
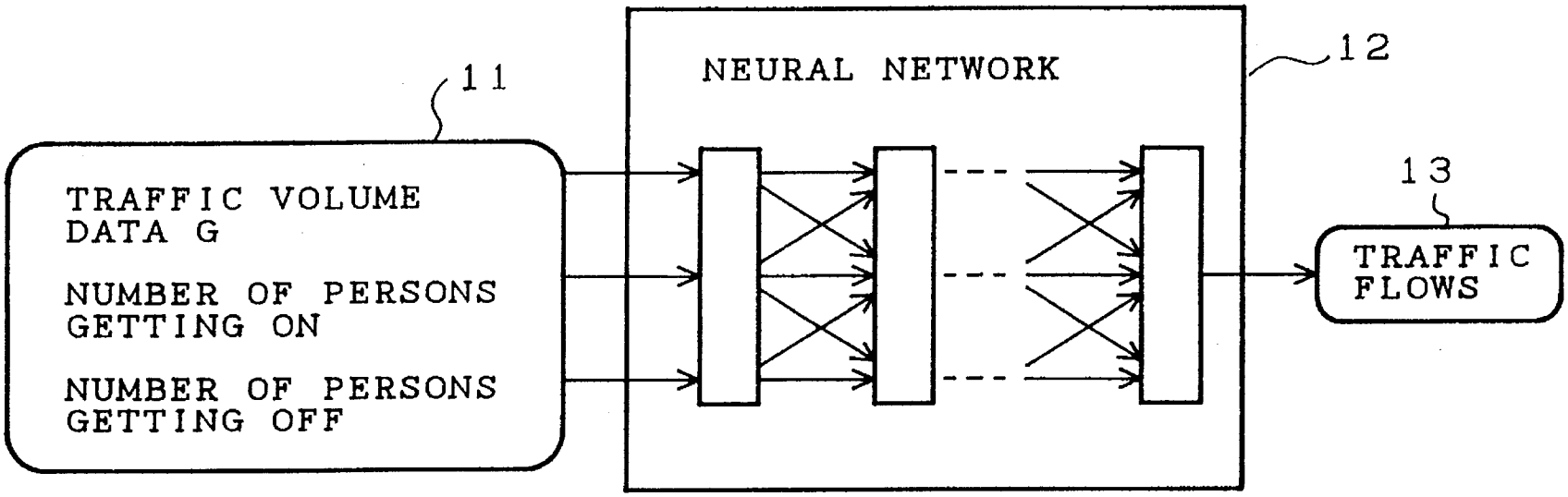
FIG. 2 is an explanatory drawing showing the basic concept of the traffic flow presumption of the present invention.

FIG. 2 is an explanatory drawing showing the basic concept of the traffic flow presumption of the traffic means controlling apparatus of the present invention, especially showing the case where the traffic means composed of plural elevators are the objects of the control.

In FIG. 2, reference numeral 11 designates traffic volume data composed of quantitative information such as the numbers of persons having gotten on or off at each floor and the like; numeral 13 designates traffic flows which are indicated with elements such as quantities, time, directions and the like and shows the appearances and the movements of passengers; numeral 12 designates a multi-layer type neural network presuming the traffic flows 13 from the traffic volume data 11 inputted in conformity with the beforehand set relationships between traffic volumes and traffic flow patterns.

Now, supposing that the number of passengers who get on elevators at the ith floor and get off them at the jth floor during a prescribed time zone in a building, that is to say, the number of passengers who move from the ith floor to the jth floor, is designated by reference sign "Tij", then the traffic flows in the building can be expressed as follows:

Traffic Flows: T=(T12, T13, ..., Tij, ...)

And traffic volume data generated by these traffic flows and being observable can be expressed as follows:

Traffic Volume Data: G=(p, q)

where reference sign "p" designates the number of persons getting on at each floor and reference sign "q" designates the number of persons getting off at each floor.

As described above, the traffic flow is the flow itself of traffic, and the traffic volume is the quantity generated by the traffic flow and being easily observable.

Furthermore, supposing that observable control results is designated by reference sign "E" apart from the traffic volume data, the control results E can be expressed as follows:

Control Results: E=(r, y, m)

where reference sign "r" designates response time distributions to hall calls, reference sign "y" designates the numbers of failure times distributions of predictions to each floor, reference numeral "m" designates passing times distributions because of no vacancy at each floor.

Because it is difficult to obtain exact traffic flows T directly from traffic volume data G, which do not include the information showing the movement directions of passengers, the present invention obtains the traffic flows T by means of an approximate method.

At first, many (basically all) traffic flow patterns assumed to happen in buildings are preliminarily prepared, then the traffic volume date G and the control results E both of which are produced by executing the control of each of the traffic flow patterns under specified control parameters are previously obtained by means of simulations. Some relationships between "traffic volumes, traffic flow patterns" and "traffic flow patterns, control results" can thus be obtained.

Next, the expression of the relationships of the "traffic volumes, traffic flow patterns" using a neural network will be examined. Now, for example, a multi-layer type neural network 12 shown in FIG. 2 is prepared. Then, the neural network 12 is made to be learnt by being given traffic volume data 11 at its input side and traffic flow patterns 13 generating the traffic volume data 11 at its output side as teacher data. As a result, the neural network 12 becomes outputting the most similar traffic flow pattern out of prepared traffic flow patterns to the traffic flow pattern generating inputted traffic volume data.

Consequently, to arbitrary traffic volume data, it is enabled to obtain the traffic flow which generated the traffic volume or at least the traffic flow which is closely similar to the traffic flow having generated the traffic volume by preparing enough traffic flow patterns and making them learn beforehand.

Furthermore, in the case where the same traffic volume data are produced from plural different traffic flow patterns, the control results. under specified control parameters become different when traffic flows are different, and consequently, utilizing the relationships of the "traffic flow patterns, control results" makes it possible to select the traffic flow pattern capable of obtaining specified control results out of traffic flow patterns producing the same traffic volume data.

Besides, it is possible to previously set the control parameters, with which the optimum control result can be obtained, by means of simulations and the like, and consequently, the optimum control parameters can automatically be set if traffic flows can be presumed from traffic volume data.

EMBODIMENT 1

Next, a traffic means controlling apparatus controlling an elevator group consisting of plural elevators in conformity with the aforementioned basic concept will be described as the first embodiment of the present invention.

FIG. 3 is a block diagram showing the construction of the traffic means controlling apparatus of this embodiment. In FIG. 3, reference numeral 1 designates a group supervisory controlling apparatus which leads out control parameters from traffic flow patterns presumed from traffic volume data and executing the group supervisory control on the basis of the control parameters; numerals 2-1–2-N designate car controlling apparatus respectively installed to each car (the 1st car–the Nth car) transporting passengers; numeral 3 designates a hall call input and output controlling apparatus installed at each floor hall and executing hall call input and output; and numeral 4 designates a user interface for setting or changing control parameters from the outside.

Moreover, the group supervisory controlling apparatus 1 comprises a traffic volume detecting means 1F monitoring calls made at each hall or passengers' getting on or off or the like and detecting traffic volume data, a traffic volume estimating means 1A estimating traffic volumes in prescribed time zones on the day when the control is done on the basis of the traffic volume data detected by the traffic volume detecting means 1F, a traffic flow presuming means 1B presuming traffic flow patterns on the basis of the estimated results of the traffic volume estimating means 1A, a presumption function constructing means 1C setting or correcting the presumption function of the traffic flow presuming means 1B by making it learn, a control parameter setting means 1D setting control parameters of every kind for the optimum group supervisory control on the basis of the traffic flows presumed by the traffic flow presuming means 1B and correcting the control parameters in accordance with detected control results or drive results, a drive controlling means 1E executing the group supervisory control on the basis of the set group supervisory control parameters, and a control result detecting means 1G detecting control results showing the control states of the group supervisory control executed by the drive controlling means 1E and drive results showing the actual behaviour of each elevator.

Figure 4:
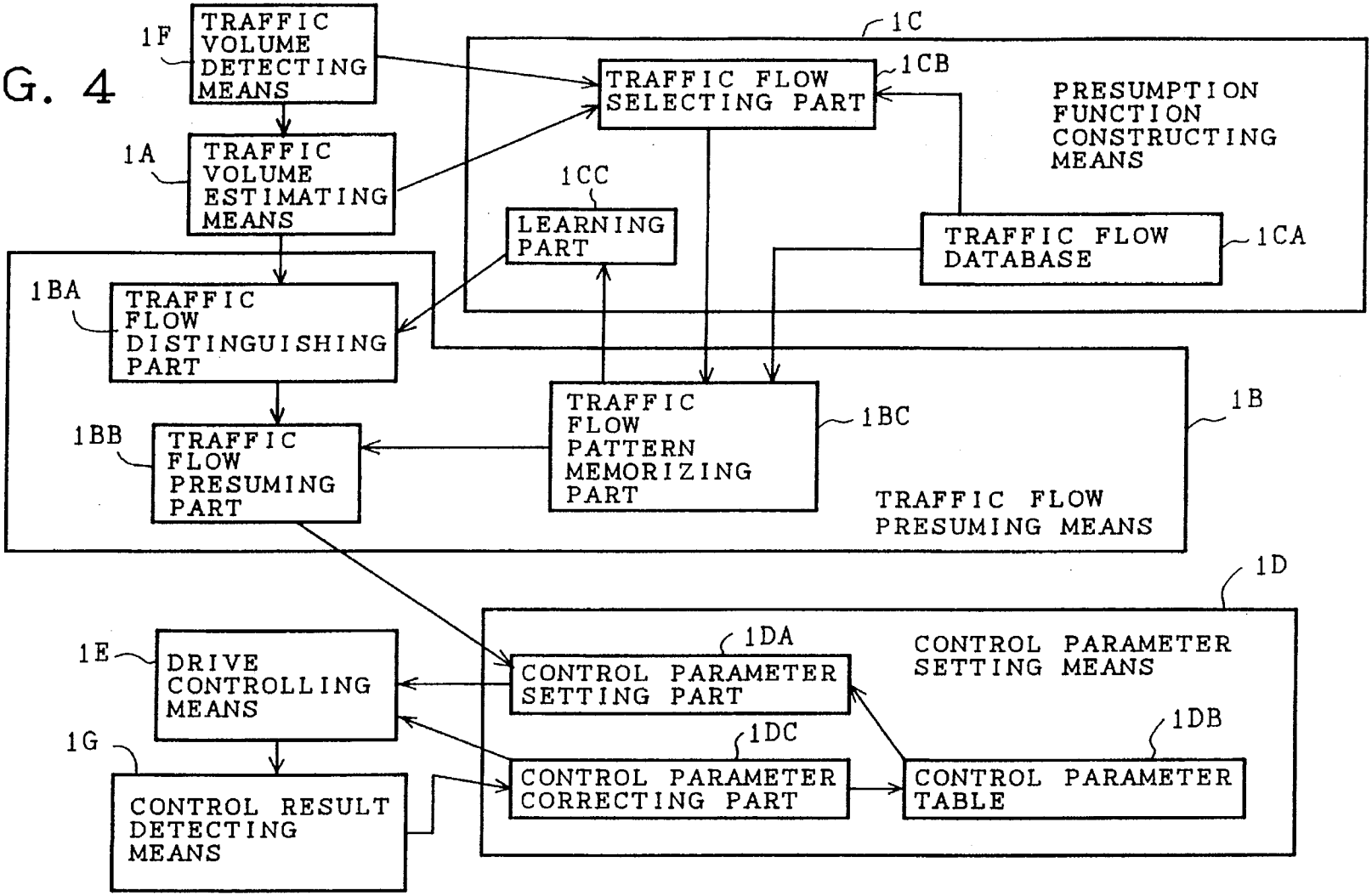
FIG. 4 is a functional block diagram showing the functional construction of the group supervisory controlling apparatus of the embodiment 1 of FIG. 3.

Furthermore, FIG. 4 is a functional block diagram showing the functional construction of the group supervisory controlling apparatus 1 of FIG. 3. The identical elements of the FIG. 4 to those of FIG. 3 described above are designated by the same reference numerals as those of FIG. 3 and the description will be omitted thereof.

In FIG. 4, the traffic flow presuming means 1B comprises a traffic flow distinguishing part 1BA having a neural network and distinguishing corresponding traffic flows by executing the prescribed network operations of traffic volume data estimated and outputted from the traffic volume estimating means 1A, traffic flow pattern memorizing part 1BC memorizing previously selected plural traffic flow patterns, and a traffic flow presuming part 1BB presuming the optimum traffic flow pattern out of the traffic flow pattern memorizing part 1BC according to the outputs of the traffic flow distinguishing part 1BA.

Furthermore, the presumption function constructing means 1C comprises a traffic flow database 1CA storing the information showing the relationships of "traffic volumes, traffic flow patterns, control results" about all assumable traffic flow patterns, a traffic flow selecting part 1CB verifying the traffic flow presuming function on the basis of the presumed traffic flow patterns and their control results, and a learning part 1CC making the neural network in the traffic flow distinguishing part 1BA learn on the basis of the traffic flow patterns memorized in the traffic flow pattern memorizing part 1BC. And the control parameter setting means 1D comprises a control parameter table 1DB in which the optimum control parameters to each traffic flow pattern are set, a control parameter setting part 1DA selecting the control parameters corresponding to the traffic flow patterns from the traffic flow presuming part 1BB out of the control parameter table 1DB, and a control parameter correcting part 1DC correcting the control parameters memorized in the control parameter table 1DB and the control parameters outputted to the drive controlling means 1E and set in the drive control means 1E in accordance with the control results and the drive results from the control results detecting means 1G.

Figure 5:
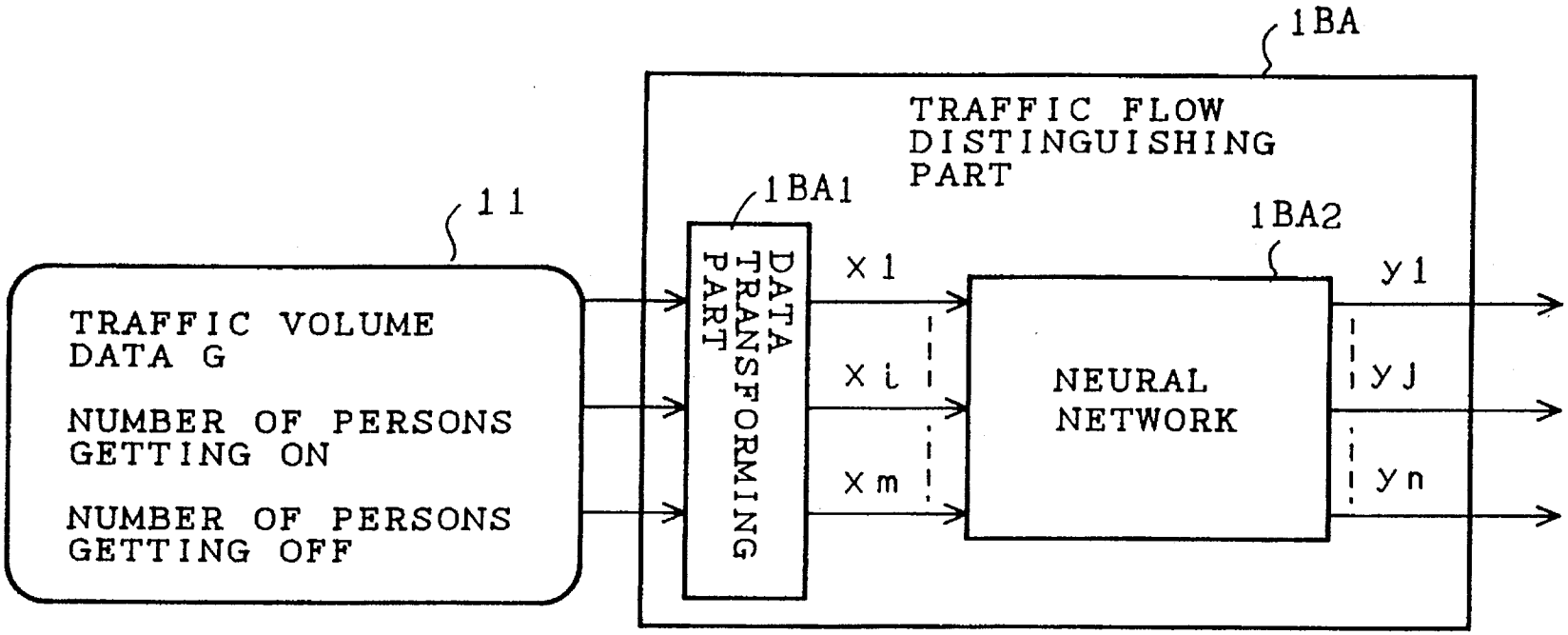
FIG. 5 is a functional block diagram showing the functional construction of the traffic flow distinguishing part of the embodiment 1 of FIG. 3.

FIG. 5 is a functional block diagram showing the functional construction of the traffic flow distinguishing part 1BA. In FIG. 5, the traffic flow distinguishing part 1BA comprises a neural network 1BA2 receiving each element x1, ..., xm denoting traffic volume data as its inputs and outputting outputs y1, ..., yn showing traffic flow patterns, and a data transforming part 1BA1 transforming traffic volume data G estimated by the traffic volume estimating means 1A into the each element x1, ..., xm.

Figure 6:
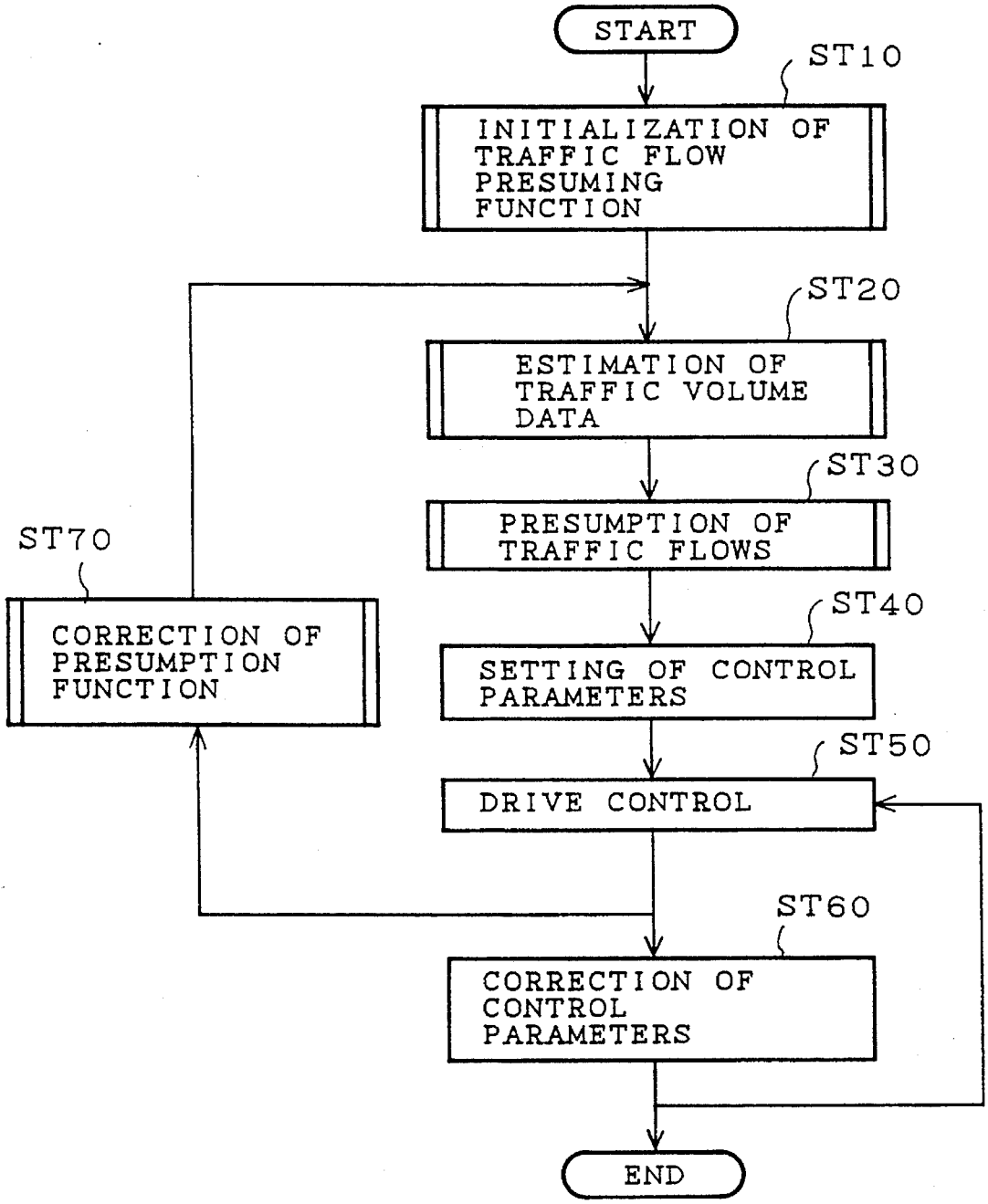
FIG. 6 is a flowchart showing the operation of the embodiment 1 of FIG. 3.

Next, the operation of the embodiment 1, especially about the group supervisory control of elevators, will be described with FIG. 6 referred. FIG. 6 is a flowchart showing the outline of the group supervisory control of elevators.

At first, before beginning the control, the presuming function of the traffic flow presuming means 1B is initialized (STEP ST10).

As described before, the traffic flow presumption of the present invention is practiced by using the neural network expressing the relationships of "traffic volumes, traffic flow patterns". The initialization of the presuming function here means that the neural network 1BA2 in the traffic flow presuming means 1B is previously set to be suitable accordingly.

Figure 7:
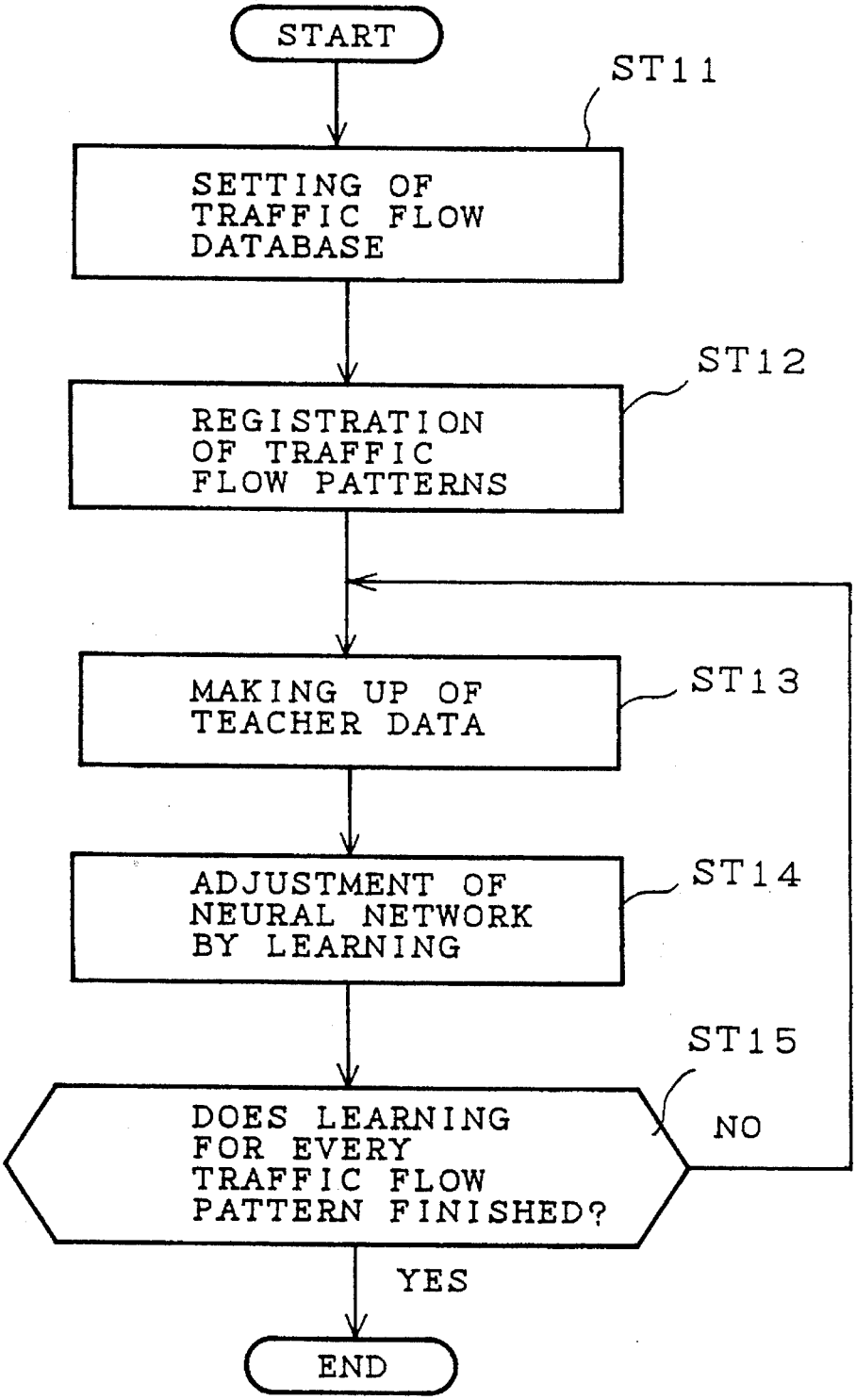
FIG. 7 is a flowchart showing the initial setting procedures of the traffic flow presuming function of the flowchart of FIG. 6 in detail.

FIG. 7 is a flowchart showing the initialization procedure of the traffic flow presuming function (STEP ST10) in detail.

Figure 8:
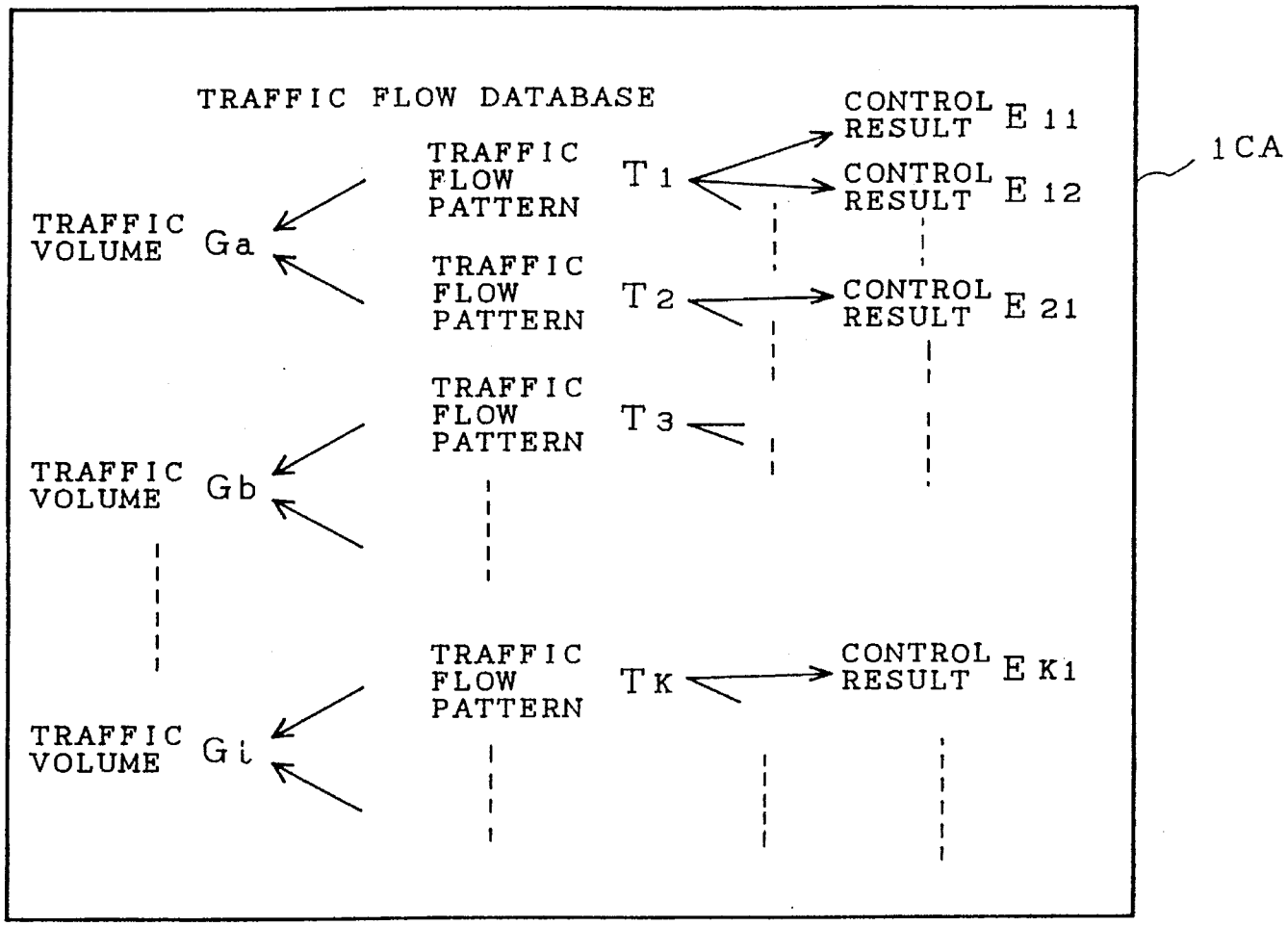
FIG. 8 is an explanatory drawing for explaining the contents of the traffic flow database in the functional block diagram of FIG. 4.

At first, assumable traffic flow patterns in the building equipped with the elevators are previously set as many as possible. And the relationships of "traffic volumes, traffic flow patterns, control results" to the set traffic flow patterns are previously obtained by practicing simulations under each control parameter. Then these relationships are arranged as shown in FIG. 8, and are stored in the traffic flow database 1CA of the presumption function constructing means 1C in advance. Besides, control results are previously evaluated, and the control parameters giving the optimum control results to each traffic flow pattern are previously registered in the control parameter table 1DB shown in FIG. 4.

FIG. 8 is an explanatory drawing showing the relationships of "traffic volumes, traffic flow patterns, control results" stored in the traffic flow database 1CA.

It can be considered to make the neural network learn all the relationships of "traffic volumes, traffic flow patterns" stored in the traffic flow database 1CA in advance, but a large scale neural network would be required for learning vast data and there are limitations of memories and control time necessary for computers. Then it is not so realistic.

Accordingly, traffic flow patterns, which generate traffic volume data being different from each other and the number of which is considered to be necessary and enough for the control of the elevators installed in the building, are previously selected out of the traffic flow patterns stored in the traffic flow database 1CA to resister in the traffic flow pattern memorizing part 1BC of the traffic flow presuming means 1B in advance (STEP ST12).

Now, indexes (1, ..., n; n: the number of traffic flow patterns) are previously given to the traffic flow patterns registered in the traffic flow pattern memorizing part 1BC. And, the number of the neurons of the input layers of the neural network 1BA2 is set to be same as the number of the elements "m" of traffic volume data G, and further the number of the neurons of the output layers is set to be same as the number of the traffic flow patterns "n". The number of intermediate layers and the number of neurons of each intermediate layer are set arbitrarily in accordance with the specification of the building or the number of elevators.

Next, for the setting of the neural network 1BA2 by the learning part 1CC, teacher data are made up from the relationships between each traffic flow pattern registered in the traffic flow pattern memorizing part 1BC and the traffic volume data generated by these traffic flow patterns (STEP ST13).

To put it concretely, the input side teacher data are composed of the values "X" ($X=(x1, ..., xm)$, $0 \leqq x1, ..., xm \leqq 1$, m: the number of. elements of traffic volume data G) which are each element value of the traffic volume data transformed into the form capable of inputting into the neural network 1BA2. Also, if the traffic volume data is generated by the kth traffic flow patterns Tk, the output side teacher data are composed of the outputs "Y" ($Y=(y1, ..., yn)$, $0 \leqq y1, ..., yn \leqq 1$) of each neuron in the output layers of the neural network 1BA2 in which the value of the output corresponding to Tk is set to be 1 and the value of the other outputs are set to be 0, that is to say, the teacher data are designated as the following equations:

$yi=1$ (when $i=k$)

$yi=0$ (when $i \div k$)

Successively, the learning is done by means of, for example, well known Back Propagation Method using the teacher data thus made, and the neural network 1BA2 in the traffic flow distinguishing part 1BA is adjusted (STEP ST14), and further aforementioned procedures (STEPs ST13, ST14) are repeated until the learning of all the traffic flow patterns registered in the traffic flow pattern memorizing part 1BC (STEP ST15).

By setting the neural network 1BA2 appropriate by making them learn in the procedures mentioned above (STEPs ST11, ST15) in advance, the neural network 1BA2 becomes outputting a large value (near to 1) from the neuron of the output layer corresponding to the similar traffic flow pattern to the traffic flow having generated the traffic volume and outputting small values (near to 0) from the neurons of the output layers corresponding to the not so much similar traffic flow patterns in conformity of the general characteristics of neural networks when arbitrary traffic volume data are inputted. That is to say, if the inputted traffic volume data are ones generated by the traffic flow closely similar to the traffic flow pattern Tk, the neural network 1BA2 in the traffic flow distinguishing part 1BA outputs the value yk closely similar to 1 ($yk \div 1$) only from the neuron in the output layer corresponding to the traffic flow pattern Tk, and outputs values yi closely similar to 0 from the neurons in the other output layers ($yi \div 0$, $i \pm k$). Consequently, the neural network 1BA2 can be considered to output the similarity between the traffic flow generating inputted traffic volume data and each traffic flow pattern.

The above mentioned is the description of the initialization of the traffic flow presuming function (STEP ST10 in FIG. 6).

Next, in FIG. 6, for the elevator group supervisory controlling procedures on the day practicing the control, the traffic flow estimating means 1A first estimates the estimation traffic volume G in the prescribed time zone on the day, and transmits the estimated traffic volume data to the traffic flow presuming means 1B (STEP ST20).

The traffic flow presuming means 1B presumes traffic flows from the transmitted data by the traffic volume estimating means 1A (STEP ST30).

Figure 9:
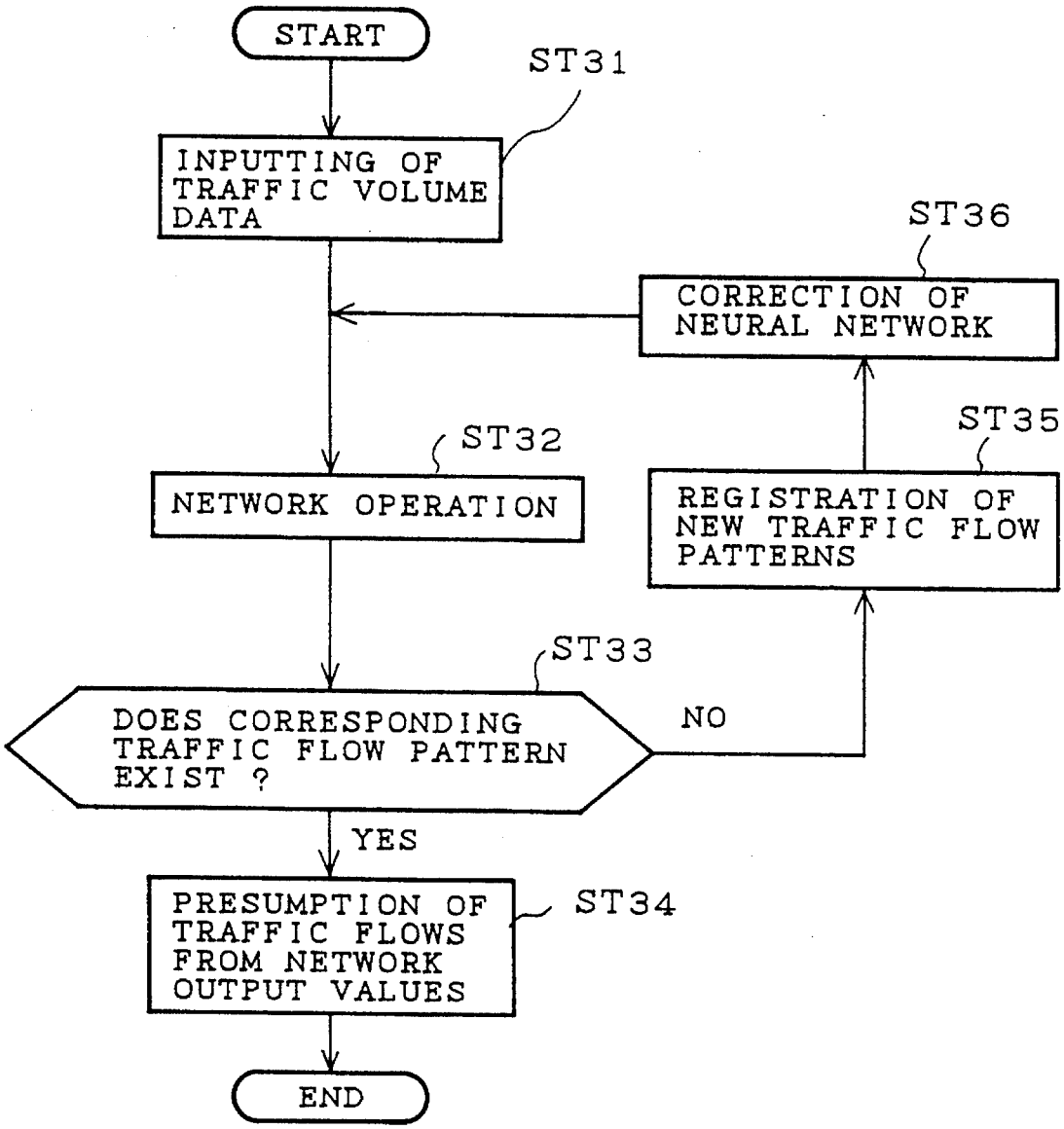
FIG. 9 is a flowchart showing the traffic flow presuming procedure in the flowchart of FIG. 6 in detail.

Hereinafter, the detail of the traffic flow presuming operation (STEP ST30) will be described with reference made to FIG. 9. FIG. 9 is a flowchart showing the traffic flow presuming procedure.

At first, the traffic volume data estimated by the traffic volume estimating means 1A are inputted into the traffic flow distinguishing part 1BA (STEP ST31). After the traffic volume data are transformed into each element x1, ..., xm by the data transforming part 1BA1 of the traffic flow distinguishing part 1BA, the neural network 1BA2 executes well-known network operations and the output values y1, ..., yn of the neural network 1BA2 are transformed to the traffic flow presuming part 1BB (STEP ST32).

Next, the traffic flow presuming part 1BB determines in accordance with the transmitted output values y1, ..., yn whether the traffic flow pattern corresponding to or very similar to the traffic flow essentially generating the inputted traffic volume data exists in the traffic flow pattern memorizing part 1BC or not (STEP ST33). To put it concretely, specified threshold values hmax, hmin (for example, hmax=0.9, hmin=0.1) are set, and if only one output value among the output values y1, ..., yn is larger than the threshold value hmax and the other output values are smaller than the threshold value hmin as follows:

$yk>hmax$ $yj<hmin$ ($j=1, ..., n, j\pm k$)

then, the traffic flow pattern (the kth traffic flow pattern Tk) corresponding to the output value (yk in the above mentioned example) having larger value than the threshold value hmax is determined to be the corresponding traffic flow pattern, and further the other cases are determined as the cases where no corresponding traffic flow patterns are.

If this determination shows that there is a corresponding traffic flow pattern (STEP ST33), the determined traffic flow pattern is transmitted to the control parameter setting means 1D (STEP ST34).

Also, if this determination shows that there is no corresponding traffic flow patterns (STEP ST33), the traffic flow selecting part 1CB newly select one traffic flow pattern out of the traffic flow database 1CA and resister it to the traffic flow pattern memorizing part 1BC (STEP ST35), and further the learning part 1CC execute the learning in conformity with the procedures like those of the setting of the neural network 1BA2 (STEPs ST12–ST15 in FIG. 7) to correct the neural network 1BA2 (STEP ST36). Such the registration of the new traffic flow pattern (STEP ST35) and the correction of the neural network 1BA2 (STEP ST36) are repeated until the determination of the existence of the corresponding traffic flow pattern is made (STEP ST33).

The selection method of the new traffic flow pattern is that the traffic flow pattern generating the traffic volume data having the smallest distance from the inputted traffic volume data is at first selected and then traffic. flow patterns generating the traffic volume data having smaller distance from the inputted traffic volume data are successively selected, where the distance from the inputted traffic volume data is designated, for example, as follows:

$Gdist=|G-G'|^2$

G: inputted traffic volume data

G': traffic volume data 9enerated by traffic flow patterns

The aforementioned is the description of the traffic flow presuming procedures.

Besides, in the case where the capability of the computer executing each procedure in the flowchart of FIG. 9 is limited, the procedures concernin$_g$ the correction of the neural network 1BA2 (STEPs ST33, ST35, ST36) may be done in one time apart from daily controls and the selection of the traffic flow patterns may be done by selecting the traffic flow pattern having the highest similarity, that is to say, the traffic flow pattern corresponding to the maximum value among the output values y1, ..., yn of the neural network 1BA2, without setting the threshold values. In this case, if there are plural traffic flow patterns corresponding to the maximum value, one of them may be selected randomly, or one having the high frequency of having been selected in the past in the same time zone may be selected. Next, in FIG. 6, after any traffic flow pattern was selected as the traffic flow presuming value, the control parameter setting part 1DA selects and sets the optimum control parameters previously set in accordance with the selected traffic flow out of the control parameter table 1DB (STEP ST40). Then, the drive control means 1E executes the group supervisory control on the basis of the set control parameters (STEP ST50).

Furthermore, the control result detecting means 1G detects the control results of the group supervisory control by the drive control means 1E and the drive results of each elevator, and the control parameter correcting part 1DC corrects control parameters in accordance with the detected control results and the drive results (STEP ST60).

Hereinafter, this correcting procedure of control parameters (STEP ST60) will be described.

As mentioned above, control parameters can be set to the values with which the optimum control results can be obtained by means of previously executing simulations according to the traffic flows and the like. Because the traffic flows presumed by the traffic flow presuming means 1B (STEP ST30) are essentially approximate ones, some errors could happen between the presumed traffic flows and actual passengers' movements. In such cases, the values set by the control parameter setting means 1D (STEP ST40) are made to be the standard values of the control parameters, and correction is done according to the control results after executing the group supervisory control by the drive control means 1E (STEP ST50) or according to the drive results of each elevator to the standard values (STEP ST60).

There are the on-line tuning method and the off-line tuning method in the correcting methods of the control parameters.

The on-line tuning method is the method executing the correction of the control parameters as follows: that is to say, the method first monitors control results and drive results every unit time (for example, every 5 minutes) for arbitrary time zone TB of the traffic flows presumed by the traffic flow presuming means 1B (STEP ST30), then if the control result or the drive result at the unit time satisfies prescribed conditions, the method corrects the values of control parameters in accordance with the control result or the drive result from the standard values, and thereafter the method executes the control using the corrected control parameters for the time zone TB of the traffic flow.

On the other hand, the off-line tuning method is the method executing the correction of the control parameters as follows: that is to say, the method monitors control results and drive results over all time zones of the traffic flows presumed by the traffic flow presuming means 1B (STEP ST30), then if the control results or the drive results satisfy prescribed conditions, the method corrects the standard values of the control parameters in accordance with the control results or the drive results and changes the contents of the control parameter table 1DB.

By executing such the corrections, the control parameters suitable for the characteristics of the building are lead out and better group supervisory control becomes capable of being practiced.

Furthermore, in FIG. 6, the correction of the traffic flow presuming function is periodically practiced apart from these daily controllings (STEP ST70). Such the correction may be practiced after finishing the daily controlling, or may be done every prescribed terms, for example every week.

Figure 10:
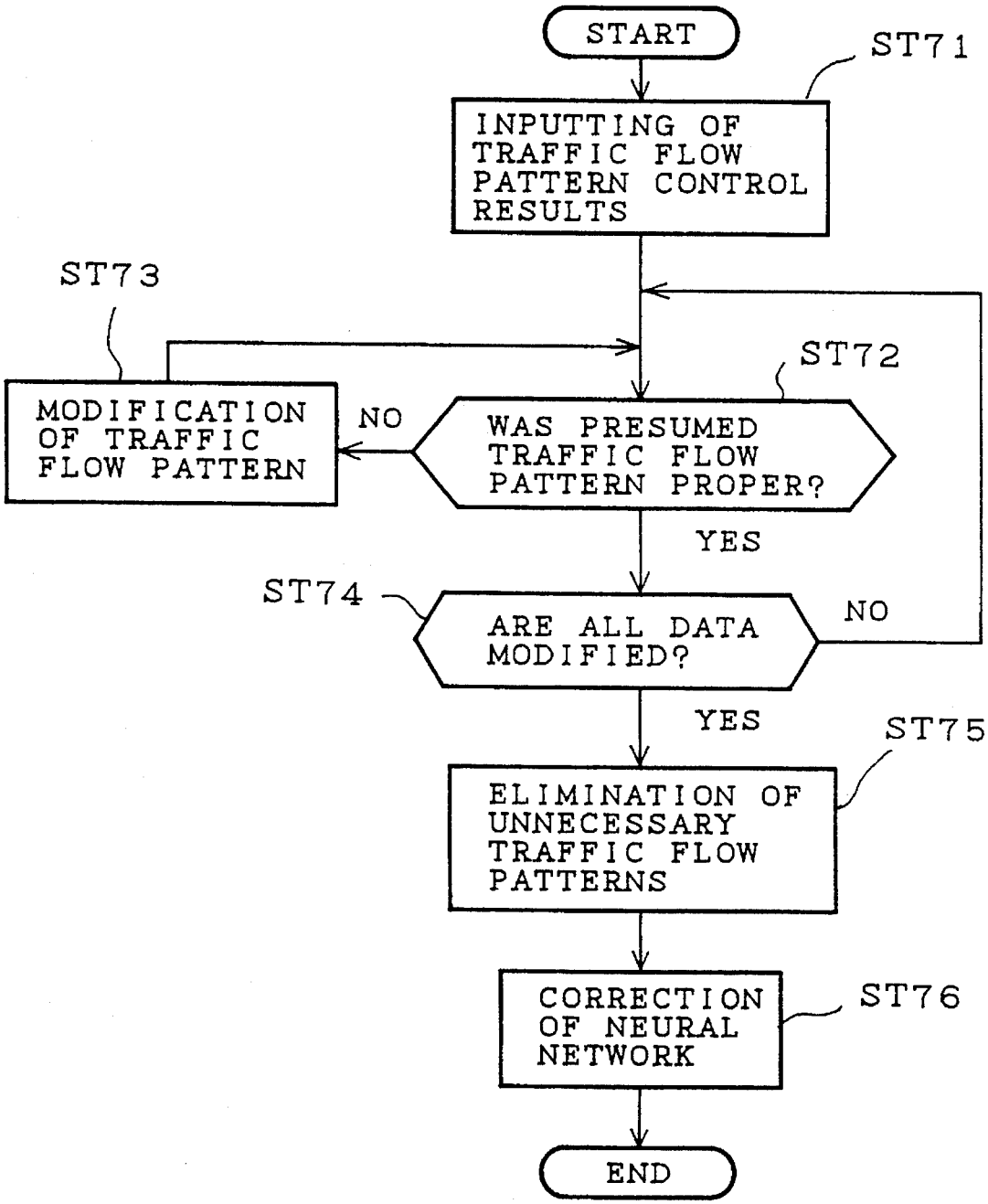
FIG. 10 is a flowchart showing the correcting procedure of the traffic flow presuming function in the flowchart of FIG. 6.

Hereinafter, the detail of the periodical correction procedures will be described with FIG. 10 referred. FIG. 10 is a flowchart showing the correction procedure of the traffic flow presuming function by the presuming function constructing means 1C (STEP ST70). This procedure (STEP ST70) is different from the STEPs ST33, ST35, and ST36 of FIG. 9, but each step of STEPs ST33, ST35, and ST36 may be included in the procedure (STEP ST70) in the case where the ability of the computer is limited as described before.

At first, actual traffic volume data detected by the traffic volume data detecting means 1F in the past and actual control results (control results E) are monitored in advance, and traffic flow presumption to the detected actual traffic volume data is also previously made by the use of the same procedures as the traffic flow presuming procedures (STEP ST30). Then, these control results and presumed traffic flow patterns are inputted into the presumption function constructing means 1C (STEP ST71).

And, whether the the traffic flow presumption function was proper or not is verified by the use of each relationship of the "traffic flows, control results" (STEP ST72), and the contents of the traffic flow pattern memorizing part 1BC are modified in case of being determined not to be proper (STEP ST73).

Now, it is ensured that the traffic volume data generated by the presumed traffic flow pattern are very similar to the traffic volume data detected by the traffic volume detecting means 1F for the results of each procedure of the initializing procedure of the traffic flow presumption function (STEP ST10) and the traffic flow presuming procedure (STEP ST30), further the presumed traffic flow pattern is surely registered in the traffic flow pattern memorizing part 1BC. But, as described before, there is some traffic flow patterns which are not registered in the traffic flow pattern memorizing part 1BC and generate the same traffic volume data in the traffic flow database 1CA.

Accordingly, a traffic flow pattern generating the same traffic volume data as the traffic flow pattern presumed by the traffic flow presuming procedure (STEP ST30) is extracted out of the traffic flow database 1CA. For example, supposing that the presumed traffic flow pattern is the traffic flow pattern T1 of FIG. 8, the traffic flow pattern T1 and the traffic flow pattern T2 generate the same traffic volume datum Ga. Since the control results of the control in conformity with each traffic flow parameter to the traffic flow patterns T1, T2 have already been memorized in the traffic flow database 1CA, the control results in conformity with the actually used control parameters, for example the control result E11 and the control result E21 of FIG. 8, are taken out of the control results. Then, these control results E11, E21 are compared with the actually observed control result E. For the comparison between the control result E and the control results E11, E21, for example, the distances $|E-E11|^2$, $|E-E21|^2$ may be used. Thereby, if the control result E11 of the traffic flow pattern T1 is less similar to the control result E than the control result E21 of the traffic flow pattern T2, it is determined that the traffic flow pattern T2 should have been assumed to be the presumption value (STEP ST72), and the traffic flow pattern T1 is eliminated from the traffic flow pattern memorizing part 1BC, and further the traffic flow pattern T2, from which the control result E21 similar to the control result E can be obtained, is registered in the traffic flow pattern memorizing part 1BC. Moreover, if the control result E11 of the traffic flow pattern T1 is more similar to the control result E than the control result E21 of the traffic flow pattern T2, it is determined to be proper that the traffic flow pattern T1 is assumed to be the presumption value (STEP ST72).

Such the alternations of the traffic flow patterns are repeated until all traffic flow patterns which are presumed from the monitored traffic volume data and control results and are inputted into the presumption function correcting means 1C are determined to be proper (STEP ST74).

Moreover, the selected frequencies of each traffic flow pattern in the traffic flow pattern memorizing part 1BC as the presumption values is monitored, and the traffic flow patterns not being selected for a long time, for example more than three moths, are determined to be unnecessary for the building equipped with the elevator to be eliminated from the traffic flow pattern memorizing part 1BC (STEP ST75).

The renewal procedures of the traffic flow patterns described above (STEPs ST71–ST75) are executed by the traffic flow selecting part 1CB, and if the contents of the traffic flow pattern memorizing part 1BC are thereby renewed, the number of the neurons in the output layers of the neural network 1BA2 is newly set to the traffic flow patterns registered in the traffic flow pattern memorizing part 1BC, and further the learning part 1CC corrects the neural network 1BA2 by making it learn (with the same procedures of STEPs ST13–ST15 of FIG. 7) (STEP ST76), then the correction procedure of the traffic flow presumption function (STEP ST70) is finished.

The neural network 1BA2 and the traffic flow pattern memorizing part 1BC can always be kept proper by executing the above mentioned procedures of correction, then the accuracy of the presumption of the traffic flow presumption function can be kept good.

The aforementioned is the description of the STEPs ST10–ST70 in the group supervisory procedure shown in FIG. 6.

Next, control parameters in elevator group supervisory will be described.

In elevator group supervisory, the improvement of the service of traffic in buildings is promoted by selecting and assigning proper elevators to each hall call at each floor, and evaluation functions are usually used to the selection of the assigned elevator. The method using the evaluation functions is a method of assigning each elevator to the latest hall call for the time of being and totally evaluating the service states anticipatable after that such as the waiting time of passengers at each hall, failures of predictions, passing through because of no vacancy, and the like by the use of evaluation functions for example shown below to select elevators so as to take the best evaluation value.

$$J(i)=Wa\times fw(i)+Wb\times fy(i)+Wc\times fm(i)+\cdots$$

J(i): the total evaluation value when the ith elevator is assigned for the time of being fw(i): the evaluation of the anticipatable waiting time of each passenger when the ith elevator is assigned for the time of being fy(i): the evaluation of the anticipatable failures of predictions when the ith elevator is assigned for the time of being fm(i): the evaluation of the passing through because of no vacancy when the ith elevator is assigned for the time of being Wa: a weighting parameter for the evaluation of the waiting time Wb: a weighting parameter for the evaluation of the failures of predictions Wc: a weighting parameter for the evaluation of the passing through because of no vacancy In the above mentioned equation, reference signs Wa, Wb, Wc are weighting parameters designating the degree of serious consideration for each evaluation items such as the waiting time and the like, and the setting of these weighting parameters has a great influence upon control results, for example setting the weighting parameter Wa for the waiting time high would enable to shorten the average waiting time but would enlarge the failures of predictions and the passing through because of no vacancy.

Furthermore, the control parameters in the elevator group supervisory are not limited to the above mentioned evaluation functions, and it is required to accurately obtain stop probabilities at each floor for, for example, accurately obtaining the prediction values of each evaluation items of aforementioned evaluation functions. These stop probabilities are generally obtained by the method of obtaining them from the number of passengers getting on or off each elevator at each floor, but they can be obtained more accurately from traffic flows as described later.

Moreover, in office buildings and the like, it is generally practiced to raise the allocation efficiency of cars to the lobby floor, where congestion is anticipated, by allocating plural elevators or dividing stoppable floors of each elevator or the like at an attendance time zone. It is also practiced to forward elevators to specified floors at a lunch time zone or a closing time zone. The settings of the numbers of allocation elevators to the lobby floor, stoppable floors or forwarding floors are also important control parameters in the elevator group supervisory.

Conventionally, it was impossible to determine the optimum values (or calculated values) of these control parameters in advance, however the method of the present invention enables to obtain the optimum values of the control parameters to each traffic flow pattern in advance by simulations and the like.

Hereinafter, some of the setting examples of the control parameters will be described.

At first, the stop probabilities at each floor will be described as the first example of the control parameters. If traffic flows are obtained, the stop probabilities at each floor of each elevator can be obtained more accurately than conventional methods.

Figure 11:
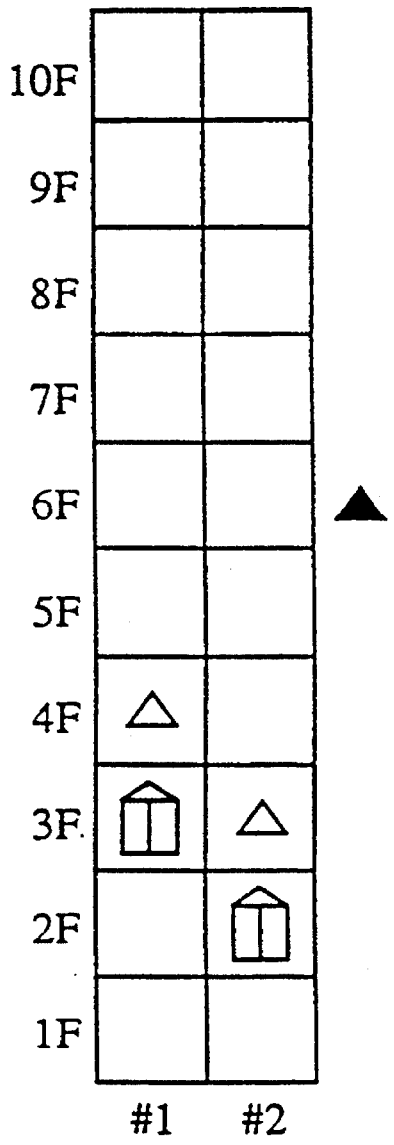
FIG. 11 is an explanatory drawing for explaining the stop probabilities in the group supervisory control of the embodiment 1 of FIG. 3.

FIG. 11 is an explanatory drawing for explaining the stop probabilities in the group supervisory control. In FIG. 11, reference numerals 1F–10F designate each floor (in a building having ten floors); reference signs #1, #2 designate elevators installed in this building; reference signs Δ designate registered calls; and reference sign ▲ designates a newly generated call.

Supposing that both of the elevators #1, #2 are running upwards, and the elevator #1 and the elevator #2 have already received registered calls respectively at the floor 4F and the floor 3F, and further it is settled to response them respectively.

In this state, if a new call is generated at the floor 6F, it is unknown which floor the passenger getting on the elevator #1 at the floor 4F will move to after the elevator #1 responds to the floor 4F in this time point. So does the elevator #2 to the call from the floor 3F. Accordingly, it was general to consider that the elevator #1 being near to the floor 6F could arrive earlier and to assign the elevator #1 to the new call at the floor 6F, since it was impossible to obtain the stop probabilities accurately after the elevators #1, #2 respectively responded to the floors 4F, 3F.

However, the present invention can accurately obtain the stop probabilities of each elevator at each floor to the floor 6F by the use of aforementioned traffic flow data as follows for example:

the stop probability of the elevator #1 at the floor kF: $ST1(k)=T4k/Ej>4T4j$ (k=5, 6)

the stop probability of the elevator #2 at the floor kF: $ST2(k)=T3k/Ej>3T3j$ (k=4, 5, 6)

For an example, in the case where passengers moving from the floor 3F to the floor 4F or 5F are few ($T34\div0$, $T35\div0$), the stop probabilities of the elevator #2 at the floors 4F and 5F can be considered to be small.

Figure 12:
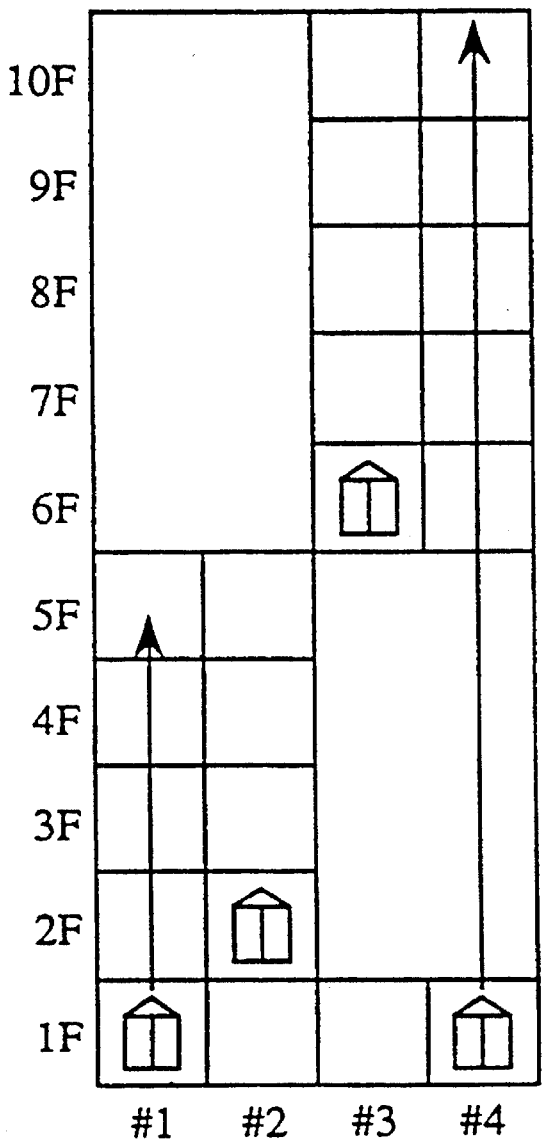
FIG. 12 is an explanatory drawing showing a setting of stoppable floors in the group supervisory control of the embodiment 1 of FIG. 3.
Figure 13A:
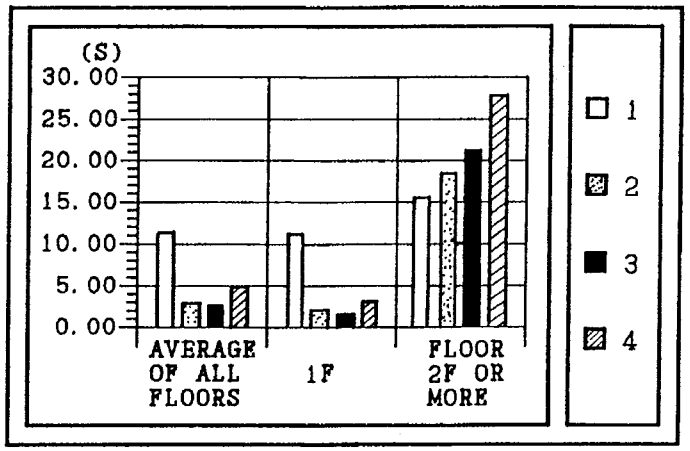
FIG. 13(*a*) –FIG. 13(*e*) are explanatory drawings for showing examples of the correction of the control parameters in the example 1 of FIG. 3.
Figure 13B:
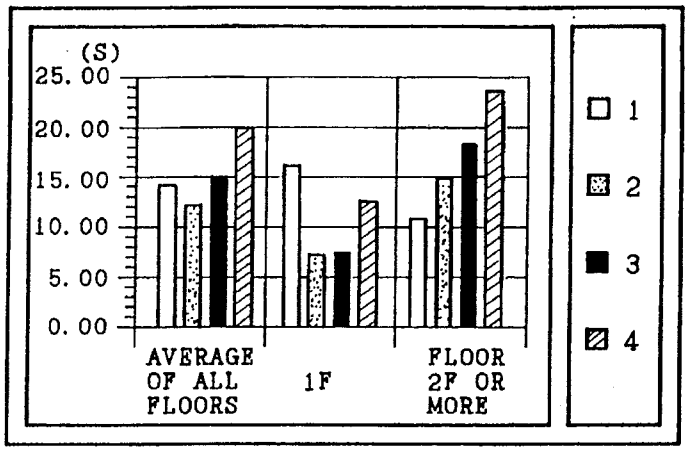
Figure 13C:
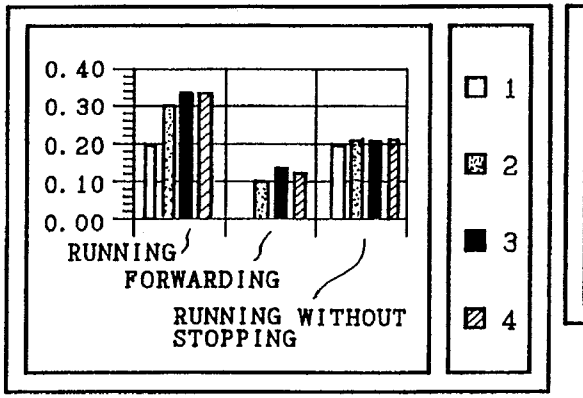
Figure 13D:
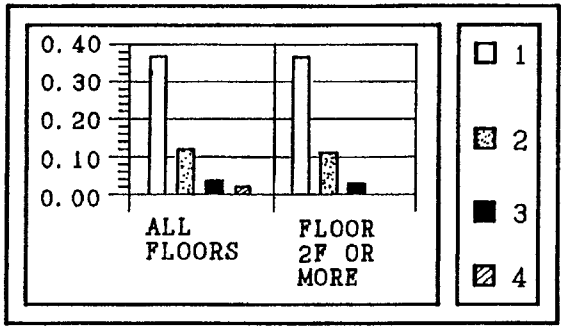
Figure 13E:
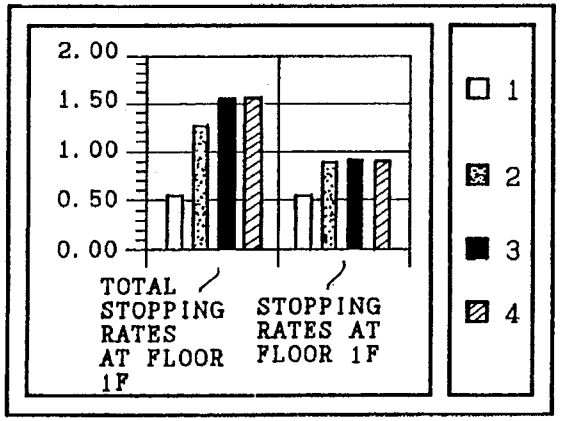

Conversely, in the case where passengers moving from the floor 4F to the floor 5F and the passengers moving from the floor 3F to the floor 6F are many, the stop probability of the elevator #1 at the floor 5F and the stop probability of the elevator #2 at the floor 6F can be considered to be large. In this case, the probability that the elevator #2 can arrive at the floor 6F earlier than the elevator #1 is obviously large, thereby to response the elevator #2 to the call at the floor 6F is determined to be more efficient. Consequently, obtaining the stop probabilities of each. elevator at each floor from the traffic flow data as control parameters enables more efficient control than in prior art. Next, as the second example of the control parameters, the setting of stoppable floors, which is one of the control parameters in attendance time zones, will be described. FIG. 12 is an explanatory drawing showing a setting of stoppable floors in the group supervisory control. In FIG. 12, reference numerals 1F–10F designate each floor (of a building having ten floors); and reference signs #1–#4 designate elevators installed in the building.

Generally, in an attendance time zone, many passengers get on the elevators #1–#4 at the lobby floor (the floor 1F in this example), the other passengers moves between the other floors. In this case, there are some buildings where the movements of passengers between each floor from the floor 2F to the floor 5F and the movements of passengers between each floor of the floor 6F and more are many but the movements of passengers who get on at each of the floors 2F–5F to the floors 6F and more or the movements of passengers from the floors 6f and more to the floors 2F–5F are little. Such states can easily be grasped if traffic flow data are obtained.

In such cases, as shown in FIG. 12, it can be considered to divide each elevator's stopping zones and set the elevators #1– #4 so that, for example, the elevators #1, #2 stop only at the floors 1F–5F and the elevators #3, #4 stop only at the floor 1F and the floors 6F and more. Thereby, the rounding efficiencies of each elevator are made to raise and the improvement of the total service in the building is promoted. Consequently, more efficient control than that of prior arts can be practiced by obtaining stop probabilities of each elevator at each floor from the traffic flow data as the control parameters. Next, the method of correcting these control parameters to the further optimum values will be described.

Now, the numbers of the allocation of elevators to the lobby floor in an office building at an attendance time zone will be considered as an example of the control parameters. It is often practiced to promote the improvement of the transportation efficiency at the lobby floor by allocating (or forwarding) plural elevators to the lobby floor at this time zone, because great many passengers generally visit the lobby floor at this time zone. Such a system is generally called Lobby Floor Plural Elevator Allocation System, and how many elevators are allocated at the lobby floor has an influence upon the transportation efficiencies of the whole building in this system.

It is required to consider the following items for determining the optimum number of elevators allocated to the lobby floor.

That is:

A: service situations to each floor

B: the allowance of equipment for traffic demand

C: drive situations at the lobby floor

D: the degree of the concentration of equipment to the lobby floor (1.4)

As mentioned above, the Lobby Floor Plural Elevator Allocation System promotes the improvement of the service to the lobby floor by concentrating equipment to the lobby floor by means of the forwarding of elevators, then the allocation of the appropriate number of elevators to the lobby floor would bring about a great deal of improvement of the service if the allowance of equipment is to some extent. But, if the allowance of the equipment is not so much, the allocation of many elevators to the lobby floor would bring about a change for the worse in the service to the floors other than the lobby floor, as the result of over concentration of equipment to the lobby floor. Accordingly, it is considered to be proper that the allocation number of elevators to the lobby floor should be corrected in conformity with, for example, the following rules from the prescribed standard values.

Now, term "IF" designates the conditions of executing correction; term "THEN" designates corrections in the case where conditions are satisfied; and term "and" designates the execution of the logical product of the former condition and the latter condition of it, in the following rules.

[CORRECTION RULE 1]
IF ( (the allowance of the equipment is large)
and (the drive situation at the lobby floor is not good)
and (the service situations to the floors other than the lobby floor are good)
and (the concentration degree of the equipment to the lobby floor is not high) )
THEN (increase the concentration degree of the equipment to the lobby floor)

[CORRECTION RULE 2]
IF ( (the allowance of the equipment is small)
and (the drive situation at the lobby floor is good)
and (the service situations to the floors other than the lobby floor are bad)
and (the concentration degree of the equipment to the lobby floor is high) )
THEN (decrease the concentration degree of the equipment to the lobby floor)

Each item included in the aforementioned conditions can concretely be denoted by the aforementioned control results E indicating the general service situations of the group supervisory system and the drive results indicating how each elevator has run and stopped (the drive results will hereinafter be denoted as Ev).

FIG. 13(*a*)–FIG. 13(*e*) are explanatory drawings showing the simulation results of the elevators' behaviour at attendance time zones in a standard building equipped with six elevators, and showing the compared results in each case where the number of the allocated elevators to the lobby floor (the floor 1F in this case) is changed (from one to four) especially. Now, that the number of the allocated elevators is one means the ordinary allocation system where plural elevators are not allocated. FIG. 13(*a*) shows the average waiting time of passengers; FIG. 13(*b*) shows hall calls and unresponded time; FIGS. 13(*c*)–13(*e*) show some examples of the drive results; i.e., FIG. 13(*c*) shows running time; FIG. 13(*d*) shows waiting rates; and FIG. 13(*e*) shows the stopping rates at the lobby floor. The average waiting time shown in FIG. 13(*a*) is generally incapable of being observed, however the other control results E and drive results Ev are observable.

For example, following data are observable as the drive results.

That is:

drive results: Ev=(Av, Av2, Run, Rst1, Rst2, Pst0, Pst)

Av: waiting rates

Av2: the waiting rates of the floor 2F or more

Run: total running time

Rst1: stopping rates at the floor 1F

Rst2: total stopping rates at the floor 1F

Pst: departing frequency from the floor 1F

Pst0: departing frequency from the floor iF without passengers (1.6)

Each item of the equation (1.4), which are included in each condition of the correction rules of the equation (1.5), can be denoted for example as follows with the control results E and the drive results of the equation (1.6):

A: service situations to each floor

[the r of the control results E: the distribution of the unresponded time to hall calls]

The waiting time of each passenger is suitable for indicating service situations, but it is incapable to measure the waiting time of each passenger. Then, the service situations are generally indicated by the unresponded time to hall calls. Provided that the waiting time and the unresponded time at the floors other than the floor 1F considerably accord with each other but they do not accord with each other at the floor 1F, as shown in FIG. 13(*a*) and FIG. 13(*b*). This is why many passengers often gets on with the one hall call at the floor 1F. In the case where plural elevators are allocated at the floor 1F, in particular, the elevators are allocated to the floor 1F without hall calls at the floor 1F, and consequently, the unresponded time to hall calls is not suitable for being used as the index for evaluating the service situations at the floor 1F, then, for example, the drive situations at the lobby floor, which will be described later, can be considered to be used as the replaceable index with the unresponded time to hall calls.

B: the allowance of equipment for traffic demand

[waiting rates Av, the waiting rates of the floor 2F or more Av2, total running time Run]

The waiting rates Av indicate the ratios of the average values of the (total) time when each elevator is in a waiting state with its door closed (out of operation state) to control time. For example, if the control time is one hour and each elevator is in its waiting state during half an hour totally on an average, the waiting rates Av becomes 0.5. Besides, that the waiting rates Av is 0 is the state where every elevator is fully operating without becoming out of operation state once, and that the waiting rates Av is 1 conversely means the state where each elevator operates at no time. Similarly, the waiting rates of the floor 2F or more Av2 indicates the ratios of the waiting states at the floors 2F or more.

Because plural elevators are allocated to the floor 1F, the more the number of the allocated elevators becomes, generally, the longer the time required for forwarding them and the longer the total running time Run becomes (FIG. 13(*c*)). As a result, the time when the elevators are in the waiting state inevitably decrease as shown in FIG. 13(*d*). In particular, the waiting rates at the floors 2F or more Av2 become small. Moreover, the forwarding time does not increase in the case where the number of allocated elevators is larger than a specified value. This is why the waiting time at the floors 2F or more are lost and the allowance for executing the forwarding becomes 0. Consequently, it can be considered that there is room for further improvement of the transportation efficiency to the floor 1F by increasing the allocated elevators, if the waiting rates at the floors 2F or more Av2 are large. Conversely, when the waiting rates at the floors 2F or more Av2 are small, it is not expectable to improve the transportation efficiency to the floor 1F, even if the allocated elevators are further increased. That the waiting rates Av (or the waiting rates Av2) are larger or the running time Run is smaller mean that the allowance of equipment is larger.

C: the drive situations at the lobby floor

[stopping rates at the floor 1F Rstl, departing frequency from the floor 1F Pst]

The stopping rates at the floor 1F Rstl indicate the ratios of the total values of the time when at least one elevator is in a stopping state (including a waiting state or a passengers' getting off state) at the floor 1F to the control time. For example, if the control time is one hour and the total value of the time when at least one elevator is in a stopping state at the floor 1F is half an hour, the stopping rate at the floor 1F Rstl becomes 0.5. Generally, the larger the stopping rate at the floor 1F Rstl is, the longer the time capable of getting on at the floor 1F. Consequently, that the stopping rate at the floor 1F Rstl is larger is considered to be that the transportation efficiency to the floor 1F is higher and that the the drive situations are better. Moreover, the departing frequency from the floor 1F Pst indicates the number of elevators departing from the floor 1F per unit time. Generally, that the departing frequency from the floor 1F are much means that the elevators are accordingly allocated to the floor 1F more frequently and that the drive situation to the floor 1F is good.

D: the degree of the concentration of equipment to the lobby floor

[total stopping rates at the floor 1F Rst2, departing frequency from the floor 1F without passengers Pst0]

The total stopping rates at the floor 1F Rst2 indicate the ratios of the (total) sum of the stopping time of each elevator at the floor 1F to the control time. For example, in the case where the control time is one hour and each elevator totally stopped at the floor iF for one hour and a half, the total stopping rate at the floor 1F Rst2 becomes 1.5. These total stopping rates at the floor 1F Rst2 indicate the degrees of the concentration of equipment to the lobby floor. The total stopping rates at the floor 1F Rst2 generally increase by increasing the number of the allocated elevators to the floor 1F, but the total stopping rates at the floor 1F Rst2 do not so much increase in the case where the number of the allocated elevators to the floor 1F reaches to a specified value. This is why the cases where plural elevators stop at the floor 1F increase. Accordingly, it is useless to allocate too much elevators at the floor 1F. It results the change of the transportation efficiency to the floors 2F or more for worse on the contrary.

Further, the departing frequency from the floor 1F without passengers Pst0 indicates the number of elevators which departed from the floor 1F with taking no passengers. That the departing frequency from the floor 1F without passengers Pst0 are large means that the elevators having forwarded to the floor 1F and departed from the floor 1F without taking passengers are many, accordingly it means that too much elevators are allocated to the floor 1F. This departing frequency from the floor 1F without passengers Pst0 can also be considered to be the index indicating the degree of the concentration of equipment.

The correcting rules of the equation (1.5) can concretely expressed, for example as follows by the use of above mentioned control results E and the drive results Ev.

```
[CORRECTION RULE 11]
    IF  {          (waiting rates Av2 are large)
                 and (stopping rates at the floor 1F Rstl are not
          large)
                 and (average unresponded time of the floors 2F or
          more is short)
                 and (total stopping rates at the floor 1F Rst2 are
          not large) }
    THEN
        {increase the number of the allocated elevators to
      the floor 1F by one}
[CORRECTION RULE 12]
    IF  {          (waiting rates Av2 are small)
                 and (stopping rates at the floor 1F Rstl are
          large)
                 and (average unresponded time of the floors 2F or
          more is long)
                 and (total stopping rates at the floor 1F Rst2 are
          large) }
    THEN
        {decrease the number of the allocated elevators to
      the floor 1F by one}          (1.7)
```

The first condition (waiting rates Av2 are large) of the conditions of [CORRECTION RULE 11] can be expressed as follows by the use of, for example, a specified threshold value.

(Av2>Th) Th: threshold value (0<Th<1) (1.8)

Similarly, the second and after conditions can be expressed by the use of threshold values, and it is also able to express the conditions by the use of fuzzy sets as the determination standards of being "large" or "small". This is similarly applied to [CORRECTION RULE 12].

Furthermore, the correction rules are not limited to the aforementioned [CORRECTION RULE 11] and [CORRECTION RULE 12], then plural correction rules can be expressed using other indexes of the drive results Ev of the equation (1.6). In this case, it can be considered to prepare plural rules having the same execution section as "increase the number of the allocated elevators" like for example [CORRECTION RULE 11].

In the case where plural rules being equivalent in meaning exist, the case where the conditions of two or more rules are concurrently satisfied can happen. In such a case, one of the rules the condition of which is satisfied may be executed.

Furthermore, the rules of the equation (1.7) and the like can be used in the on-line tuning method or the off-line tuning method of the correcting procedure of the control parameters (STEP ST60).

That is to say, the aforementioned control results E and the drive results Ev are monitored every prescribed unit time, for example every five minutes. Thereby, when they satisfy the conditions of the rules of the equation (1.7), the number of the allocated elevators is increased by one at that time point.

Similarly, the control results E and the drive results Ev are monitored over all time zones of the traffic flows presumed by the traffic flow presuming procedure of the traffic flow presuming means 1B (STEP ST30). Thereby, when they satisfy the conditions of the rules of the equation (1.7), the standard value of the number of the allocated elevators to the floor 1F may be altered to alter the contents of the control parameter table 1DB.

Besides, the threshold values in the equation (1.8) needn't necessarily be the same value in case of being used in the on-line tuning method and in case of being used in the off-line tuning method. Similarly, in the case where the rules for the correction of the control parameters are expressed by fuzzy sets, too, different fuzzy sets may be used to express the rules in the on-line tuning method and in the off-line tuning method.

The above mentioned correction of the control parameter is automatically executed especially by the control parameter correcting part 1DC of the correction parameter setting means 1D in the elevator group supervisory apparatus 1 of the traffic means controlling apparatus.

Moreover, apart from the automatic correction of the control parameters, a manager (user) may execute the setting or correcting of the control parameters through the user interface 4 from the outside. In this case, the correction rules such as the equation (1.7) are exhibited to the manager with the control results E and the drive results Ev. Also, it may be applicable to construct the system so that the manager can appoint the availability and the invalidity of each correction rule and can alter the threshold values of the rule conditions, the fuzzy sets, and the like.

By executing such corrections, the control using the control parameters suitable for building characteristics can be executed.

EMBODIMENT 2

Next, the embodiment executing the estimation and the presumption of traffic flows with a different method from that of the embodiment 1 will be described as the second embodiment of the present invention.

Figure 14A:
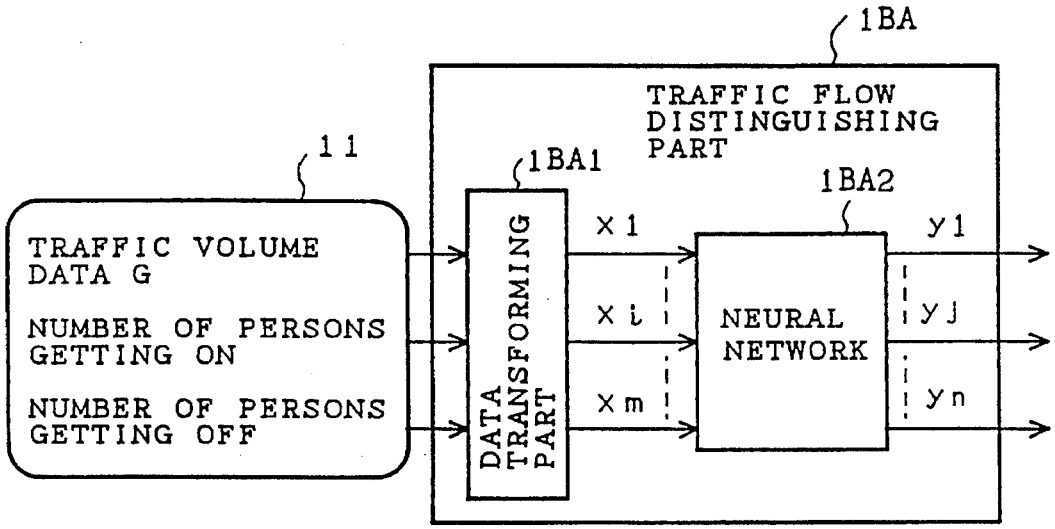
FIGS. 14A and 14B are functional block diagrams showing an example of constructions of the traffic flow distinguishing part and the traffic flow presuming part of the embodiment 2 of the present invention.
Figure 14B:
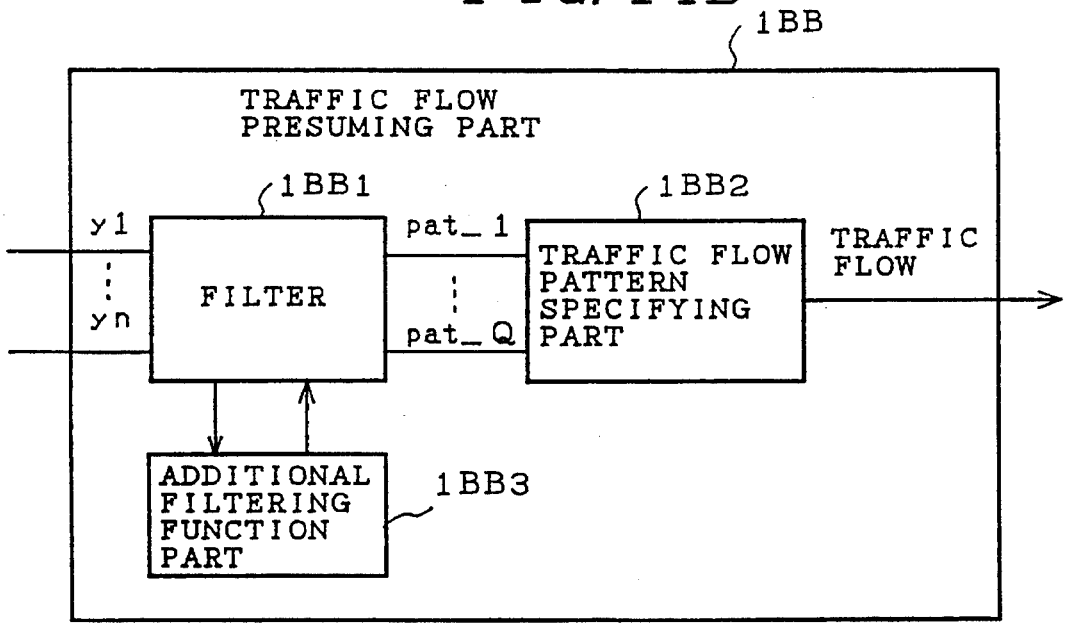

The construction of the traffic means controlling apparatus of this embodiment 2 is basically identical to that of the embodiment 1 (FIG. 3), accordingly the description concerning the basic construction of the embodiment 2 will be omitted. Provided that, in this embodiment 2, the traffic flow presuming part 1BB comprises a filter 1BB1 filtering the outputs y1, ..., yn of the neural network 1BA2, a traffic flow pattern specifying part 1BB2 specifying traffic flow patterns on the basis of the outputs of the filter 1BB1, and an additional filtering function part 1BB3 complementing the filtering function of the filter 1BB1, as shown in FIGS. 14A and 14B.

Next, the operation of the estimation and the presumption of traffic flows of this embodiment will be described. The other operation of the embodiment is the same as that of the embodiment 1, and accordingly, its description will be omitted.

In FIG. 4 and FIG. 6, for the elevator group supervisory controlling procedures on the day when the controlling is practiced, the traffic volume detecting apparatus 1F detects the traffic volumes on the day in real time, and the traffic flow estimating means 1A samples the detected traffic volumes. Thereby, traffic volumes G in the near future are estimated in real time (STEP ST20). Hereinafter, the traffic volume data estimating procedure (STEP ST20) will be described at first.

At first, the traffic volume data G(−k), ..., G(−1) for the passed k minutes before the control time point (for instance k= 5) are obtained by totalizing the detected traffic volumes, for instance, every one minute. On this, sign G(−i) designates the traffic volume during the time from i minutes before to i−1 minutes before. From them, the traffic flow datum G(0) at the control time point is obtained as follows by the use of, for instance, prescribed weights $\alpha$ ($0<\alpha<1$).

$$G(0)=E(G(-i)\times\alpha i)/E\alpha i$$

And, the traffic volume for past unit time (k minutes; for instance k=5) including the traffic volume datum G(0), that is to say, $G=G(0)+\cdots+G(-k+1)$ is made to be the estimated traffic volume.

Besides, the methods of obtaining the estimated traffic volumes are not limited to the aforementioned method. For instance, the traffic volume for past unit time (k minutes) may simply be used as the estimated traffic volume. In this case, the estimated traffic volume becomes as follows:

$$s=s(-1)+\cdots+S(-K)$$

As another method, it is applicable to multiple the traffic volume datum G(0) obtained by the aforementioned method and K together and to obtain $G=K\times G(0)$.

Then, the traffic volume data thus estimated are transmitted to the traffic flow presuming means 1B.

Next, the traffic flow presuming means 1B presumes traffic flows from the traffic volume data transmitted from the traffic volume estimating means 1A (STEP ST30).

Figure 15:
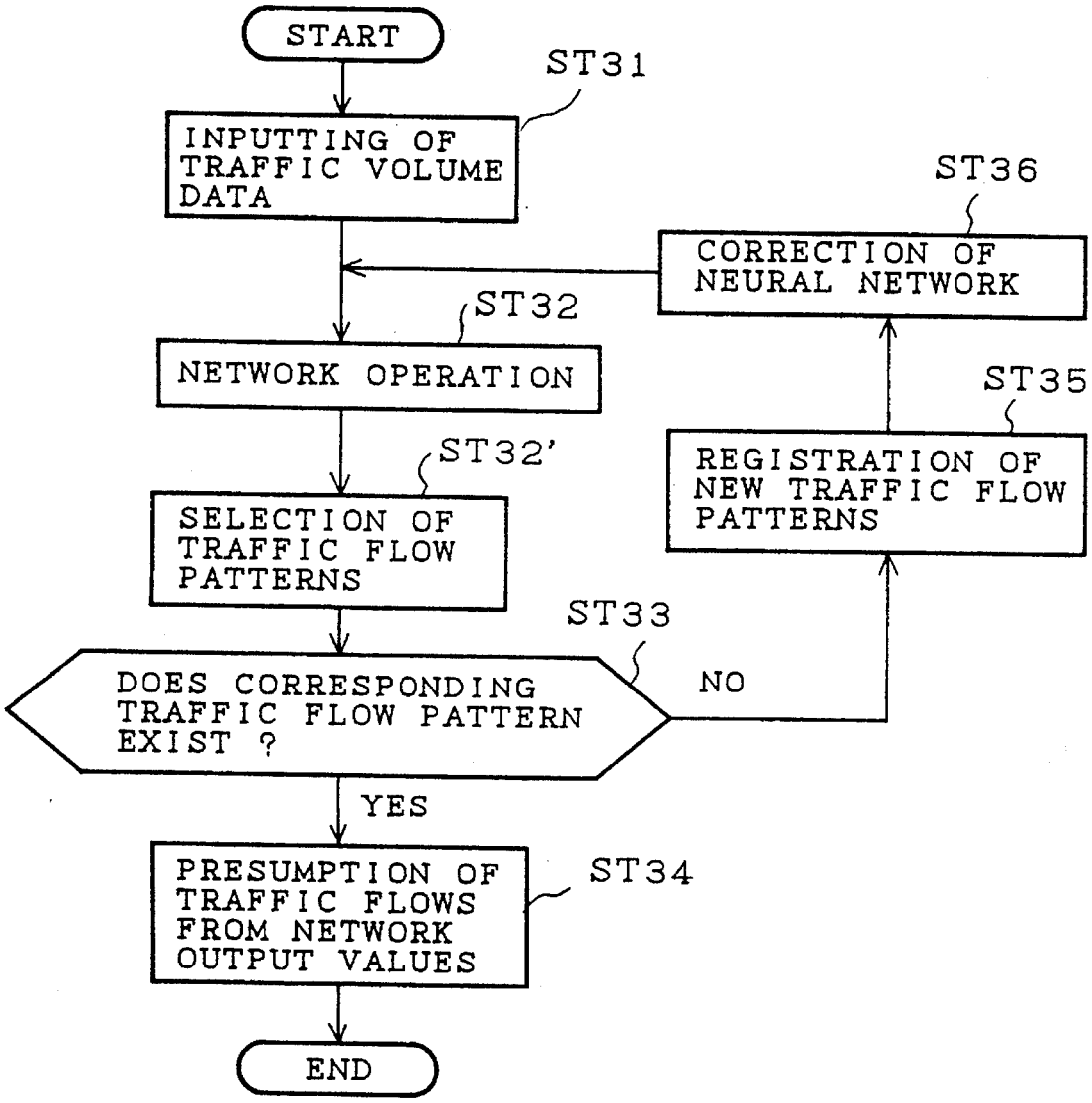
FIG. 15 is a flowchart showing the traffic flow presuming procedure of the embodiment 2 of the present invention.

Hereinafter, the detail of the traffic flow presuming procedure (STEP ST30) will be described with FIG. 15 referred. FIG. 15 is a flowchart showing the traffic flow presuming procedure. In FIG. 15, processing steps identical to those of the embodiment 1 are numbered by the use of the same step numbers as those of the corresponding steps of FIG. 9.

At first, the traffic volume data estimated by the traffic volume estimating means 1A are inputted into the traffic flow distinguishing part 1BA (STEP ST31). After the traffic volume data are transformed into each element x1, ..., xm by the data transforming part 1BA1 of the traffic flow distinguishing part 1BA, the neural network 1BA2 executes well-known network operations and the output values y1, ..., yn of the neural network 1BA2 are transformed to the traffic flow presuming part 1BB (STEP ST32).

Next, the traffic flow presuming part 1BB, which has received the output values y1, ..., yn, select a traffic flow pattern similar to the traffic flow originally generating the inputted traffic volume data out of the traffic flow pattern memorizing part 1BC in accordance with the transmitted output values y1, ..., yn (STEP ST32'). For this selection the filter 1BB1 shown in FIG. 14 is used. The inputs of the filter 1BB1 are the inputs to the traffic flow presuming part 1BB, that is to say the outputs of the neural network 1BA2, and the outputs "pat_1", ··· "pat_Q" of the filter 1BB1 ("Q" is the number of the outputs of the filter 1BB1) correspond to each traffic flow pattern, "being impossible of specifying traffic flow patterns", or "being impossible of distinguishing traffic flow patterns". And, only one of the output values of the filter 1BB1 corresponding to any one of the traffic flow patterns, "being impossible of specifying traffic flow patterns", or "being impossible of distinguishing traffic flow patterns" becomes the value of 1 and the other output values become the value of 0.

Upon this, "being impossible of specifying traffic flow patterns" indicates the case where two or more traffic flow patterns, being considered to be highly similar to each other, exist in the traffic flow pattern memorizing part 1BC and specifying any of them is impossible. Further, "being impossible of distinguishing traffic flow patterns" indicates the case where the traffic flow originally generating the inputted traffic volume data is considered not to correspond to any traffic flow pattern because any output value of the neural network 1BA2 is small. The relationship of the outputs of the neural network 1BA2 and the outputs of the filter 1BB1 is generally expressed as follows:

```
pat_i = filter_i(y1, . . ., yn) (1 ≦ i ≦ Q, Q ≧ n)
    pat_i ∈ {0, 1}
```

where sign "filter_i" designates a function expressing the filtering characteristics of the filter 1BB1 processing the inputs from the neural network 1BA2 and outputting "pat_i". As for the filtering characteristics of the filter 1BB1, some kinds of them can be considered, but only four kinds of them will be described hereinafter. Provided that the filtering characteristics of the filter 1BB1 are not limited to the four.

The first filtering characteristic among them is a maximum value filter making only one output of the filter 1BB1 the value of 1, which output of the filter 1BB1 corresponds to the output of the neural network 1BA2 having the maximum value among the output values y1, ..., yn. The following is an example of the rules of the maximum value filter.

```
IF        yi = max (y1, . . ., yn) ≠ yj
        (i ∈ (1, . . ., n), j = (1, . . ., n), i ≠ j}
THEN          pat_i = 1
            pat_j = 0
            pat_unspecifiable = 0
ELSE          pat_k = 0, {k = (1, . . ., n)}
          pat_unspecifiable = 1
```

In the above described equations, the outputs "pat_1", ..., "pat_n" of the filter 1BB1 correspond to the outputs y1, ..., yn of the neural network 1BA2. Moreover, sign "ELSE" designates to make the outputs of the filter 1BB1 the state described after the sign in the case where the conditions described before the sign are not satisfied. That is to say, the case where the conditions are not satisfied means the case where two or more maximum values exist among the output values of the neural network 1BA2. Sign "pat_unspecifiable" designates the output of the filter 1BB1 and corresponds to the "being impossible of specifying traffic flow patterns". The output "pat_unspecifiable" takes the value of 1 in the case where two or more maximum values exist among the output values of the neural network 1BA2. In this case, the number of the outputs of the filter 1BB1 becomes larger than the number of the prepared traffic flow patterns by 1, that is to say it becomes Q=n+1. The second filtering characteristic is the maximum value filter being an improvement of the first filtering characteristic. The state of "being impossible of distinguishing traffic flow patterns" cannot happen in the first filtering characteristic, but there are some cases where the determination of the traffic flow patterns by the use of the maximum value has no significance in case of the state of every output of the neural network 1BA2 being approximately the value of 0. In this case, it is reasonable to set a threshold value and to determine that the distinction of the traffic flow patterns is impossible when the maximum value of the outputs of the neurons is smaller the threshold value. An example of the rules of the improved maximum filter will be described hereinafter.

To a certain threshold value "th" (0<th<1):

```
IF        yi = max(y1, . . ., yn) ≠ yj and yi ≧ th
        {i ∈ (1, . . ., n), j = (1, . . ., n), i ≠ j}
THEN        pat_i = 1
          pat_j = 0
          pat_unspecifiable = 0
            pat_unresolvable = 0
ELSE IF         yi = yj = max(y1, . . ., yn) ≧ th
                {i, j ∈ (1, . . ., n), i ≠ j}
THEN        pat_k = 0, {k = (1, . . ., n)}
          pat_unspecifiable = 1
          pat_unresolvable = 0
ELSE        pat_k = 0, {k = (1, . . ., n)}
          pat_unspecifiable = 0
          pat_unresolvable = 1
```

In the equations above described, the output "pat_unresolvable" corresponds to the "being impossible of distinguishing traffic flow patterns", and takes the value of 1 when the muximum value of the outputs of the neural network 1BA2 is smaller than the threshold value. Besides, sign "th" designates a threshold value. In this case, the number of the outputs of the filter 1BB1 becomes larger than the number of the prepared traffic flow patterns by two, that is to say, becomes Q=n+2. Namely, in the equations described above, in the case where there is one maximum value being larger than the threshold value "th", only the output value of the filter 1BB1 which corresponds to the input value "yi" taking the. maximum value becomes the value of 1, and the other output values of the filter 1BB1 become the value of 0. Moreover, in the case where there are two maximum values being larger than the threshold value "th", all the output values of the filter 1BB1 which correspond to the outputs y1, ..., yn become the value of 0, and only the output value "pat_unspecifiable" becomes the value of 1. Furthermore, in the case where the maximum value is smaller than the threshold value "th", only the output value "pat_unresolvable" becomes the value of 1.

The third filtering characteristic is a threshold value filter which has a set threshold value and makes the output value of the filter 1BB1 the value of 1, which output of the filter 1BB1 corresponds to the output of the neural network 1BA2 larger than the threshold value. In this case, the cases of the "being impossible of specifying traffic flow patterns" and the "being impossible of distinguishing traffic flow patterns" happen. And, some rules to select the case of the "being impossible of specifying traffic flow patterns" are conceivable. Two kinds of examples among them will be described, but as a matter of course the rules to select the case of the "being impossible of specifying traffic flow patterns" are not limited to the two.

At first, the first threshold value filter is designated as the threshold value filter 1. In the threshold value filter 1, the case of the "being impossible of specifying traffic flow patterns" is selected when there are two or more outputs taking larger values than the threshold value among the outputs y1, ..., yn of the neural network 1BA2. The rules of the threshold value filter 1 will be described as follows.

To a certain threshold value "th" (0<th<1):

```
IF        yi ≧ th and yj < th
        {i ∈(1, . . ., n), j = (1, . . ., n), i ≠ j}
THEN        pat_i = 1
          pat_j = 0
          pat_unspecifiable = 0
          pat_unresolvable = 0
ELSE IF         yi ≧ th and yj ≧ th
          {i, j ∈ (1, . . ., n), i ≠ j}
```

-continued

```
THEN      pat_k = 0, {k = (1, . . ., n)}
          pat_unspecifiable = 1
          pat_unresolvable = 0
ELSE      pat_k = 0, {k = (1, . . ., n)}
          pat_unspecifiable = 0
          pat_unresolvable = 1
```

In the case where there is one output value of the neural network 1BA2 larger than the threshold value "th", this threshold value filter 1 makes the output value of the filter 1BB1 the value of 1, which output of the filter 1BB1 corresponds to the aforementioned output of the neural network 1BA2. And in the case where there are two or more output values of the neural network 1BA2 larger than the threshold value "th", the threshold value filter 1 selects the output "being impossible of specifying traffic flow patterns" as the output of the filter 1BB1. And further, in the case where every output of the neural network 1BA2 is smaller than the threshold value "th", the threshold value filter 1. selects the output "being impossible of distinguishing traffic flow patterns" as the output of the filter 1BB1.

Next, the second threshold value filter is designated as the threshold value filter 2. In the threshold value filter 2, the case of the "being impossible of specifying traffic flow patterns" is selected when there are two or more outputs taking larger values than a certain threshold value among the outputs y1, ..., yn of the neural network 1BA2 and when the total sum of the output values of the neural network 1BA2 exceeds another threshold value. The rules of the threshold value filter 1 will be described as follows.

To certain threshold values "th0", "th1" ($0<th1 \leqq th0<1$) and "th2" ($0<th2<n$):

```
IF        yi ≧ th0 and yj < th1
          {i ∈ (1, . . ., n), j = (1, . . ., n), i ≠ j}
THEN      pat_i = 1
          pat_j = 0
          pat_unspecifiable = 0
          pat_unresolvable = 0
ELSE IF        Σyk ≧ th2 {k = (1, . . ., n)}
   THEN       pat_k = 0, {k = (1, . . ., n)}
              pat_unspecifiable = 1
              pat_unresolvable = 0
ELSE      pat_k = 0, { k = (1, . . ., n)}
          pat_unspecifiable = 0
          pat_unresolvable = 1
```

where signs "th0" and "th1" are threshold values to the output values of the neural network 1BA2, and sign "th2" is a threshold value to the total sum of the output values of the neural network 1BA2. These threshold values may be same or different form each other.

That is to say, in the case where one output value of the neural network 1BA2 is larger than the threshold value "th0" and the other output values of the neural network 1BA2 are smaller than the threshold value "th1", this threshold value filter 2 makes the output value of the filter 1BB1 the value of 1, which output of the filter 1BB1 corresponds to the output of the neural network 1BA2 outputting the larger value than the threshold value "th0". And in the case where the above described condition is not satisfied and the total sum of the output values of the neural network 1BA2 is larger than the threshold value "th2", the threshold value filter 2 makes the output "pat_unspecifiable" of the filter 1BB1 the value of 1 as "being impossible of specifying traffic flow patterns". And further, in the case where any condition above described is not satisfied, the threshold value filter 2 makes the output "pat_unresolvable" of the filter 1BB1 the value of 1 as "being impossible of distinguishing traffic flow patterns".

The fourth filtering characteristic takes the inputs to the filter 1BB1 the ratios of each output value to the total output value in place of the outputs y1, ..., yn of the neural network 1BA2. In this case, if the inputs to the filter 1BB1 are designated by the reference signs z1, ..., zn, the input zi {i=(1, ..., n)} is expressed as the following equation, and the rules of the filter 1BB1 are aforementioned each characteristic the input yi of which is modified to the input zi corresponding to the input yi.

$zi=yi/Eyi$

Next, the function of the additional filtering function part 1BB3 added to the filter 1BB1 will be described. The filtering function part 1BB3 cannot select the traffic flow patterns by itself, but it can decrease the cases of the "being impossible of specifying traffic flow patterns" and the "being impossible of distinguishing traffic flow patterns" by means of being combined with the filter 1BB1.

At first, the additional filtering function to the threshold value filters will be described. This function is to do the re-selection of the traffic flow patterns by making the threshold values smaller in the case where the "being impossible of distinguishing traffic flow patterns" happens in the threshold value filter 1 or 2. Generally, making a threshold value smaller increases the cases of the "being impossible of specifying traffic flow patterns", and making a threshold value larger increases the cases of the "being impossible of distinguishing traffic flow patterns". Accordingly, the number of the cases of the "being impossible of specifying traffic flow patterns" or the "being impossible of distinguishing traffic flow patterns" is decreased by using a large threshold value usually and by using a smaller threshold value only when the case of the "being impossible of distinguishing traffic flow patterns" happens.

Now, as an example, the rules of the threshold value filter 3 which is composed by adding the additional threshold value filtering function 1 to the threshold value filter 1 will be described.

To a certain threshold value "th" ($0<th<1$) and the decreased amount of the threshold value "Δth_dec" ($0 \leqq \Delta th_dec < th$):

```
IF        yi ≧ th and yj < th
          {i ∈ (1, . . ., n), j = (1, . . ., n), i ≠ j}
THEN        pat_i = 1
          pat_j = 0
          pat_unspecifiable = 0
          pat_unresolvable = 0
ELSE IF       yi ≧ th and yj ≧ th
          {i, j ∈ (1, . . ., n), i ≠ j}
   THEN     pat_k = 0, {k = (1, . . ., n)}
            pat_unspecifiable = 1
            pat_unresolvable = 0
ELSE IF       yi ≧ th − Δth_dec and yj < th − Δth_dec
              {i, j ∈ (1, . . ., n), i ≠ j}
   THEN     pat_i = 1
            pat_j = 0
            pat_unspecifiable = 0
            pat_unresolvable = 0
ELSE      pat_k = 0, {k = (1, . . ., n)}
          pat_unspecifiable = 0
          pat_unresolvable = 1
```

That is to say, this threshold value filter 3 does not directly output the "being impossible of distinguishing traffic flow patterns" in the case where there are two or more output values of the neural network 1BA larger than the threshold value "th", but the threshold value filter 3 decreases the threshold value "th" to the threshold value "th−Δth_dec". And in the case where there is only one output value of the neural network 1BA2 larger than the decreased threshold value "th–Δth_dec", the threshold value filter 3 makes the output value of the filter 1BB1 the value of 1, which output of the filter 1BB1 corresponds to the output of the neural network 1BA2 larger than the decreased threshold value "th–Δth_dec". Thereby, the number of the case of the "being impossible of distinguishing traffic flow patterns" can be decreased.

Next, the additional threshold value filtering function 2 will be described. This function is to do the re-selection of the traffic flow patterns by making the threshold values larger in the case where the "being impossible of specifying traffic flow patterns" happens in the threshold value filter 1 or 2. Generally, making a threshold value smaller increases the cases of the "being impossible of specifying traffic flow patterns", and making a threshold value larger increases the cases of the "being impossible of distinguishing traffic flow patterns". Accordingly, the number of the cases of the "being impossible of specifying traffic flow patterns" or the "being impossible of distinguishing traffic flow patterns" is decreased by using a small threshold value usually and by using a larger threshold value only when the case of the "being impossible of specifying traffic flow patterns" happens.

Now, as an example, the rules of the threshold value filter 4 which is composed by adding the additional threshold value filtering function 2 to the threshold value filter 1 will be described.

To a certain threshold value "th" (0<th<1) and the increased amount of the threshold value "Δth_inc" (0≦Δth_inc <th):

```
IF      yi ≧ th and yj < th
      {i ∈ (1, . . ., n), j = (1, . . ., n), i ≠ j}
THEN        pat_i = 1
          pat_j = 0
          pat_unspecifiable = 0
          pat_unresolvable = 0
ELSE IF           yi ≧ th and yj ≧ th
          {i, j ∈ (1, . . ., n), i ≠ j}
          THEN IF       yi ≧ th + Δth_inc and yj < th+Δth_inc
                              {i, j ∈ (1, . . ., n), i ≠ j}
                THEN    pat_i = 1
                        pat_j = 0
                        pat_unspecifiable = 0
                        pat_unresolvable = 0
      ELSE        pat_k = 0, {k = (1, . . ., n)}
                pat_unspecifiable = 1
                  pat_unresolvable = 0
ELSE        pat_k = 0, {k = (1, . . ., n)}
          pat_unspecifiable = 0
          pat_unresolvable = 1
```

That is to say, this threshold value filter 4 does not directly output the "being impossible of specifying traffic flow patterns" in the case where there are two or more output values of the neural network 1BA larger than the threshold value "th", but the threshold value filter 3 increases the threshold value "th" to the threshold value "th+Δth_inc". And in the case where there is only one output value of the neural network 1BA2 larger than the increased threshold value "th+Δth_inc", the threshold value filter 3 makes the output value of the filter 1BB1 the value of 1, which output of the filter 1BB1 corresponds to the output of the neural network 1BA2 larger than the increased threshold value "th+Δth_inc". Thereby, the number of the case of the "being impossible of specifying traffic flow patterns" can be decreased.

Next, the additional threshold value filtering function 3 will be described. This function is to do the re-selection of the traffic flow patterns by making the threshold value larger in the case where the "being impossible of specifying traffic flow patterns" happens or by making the threshold value smaller in the case where the "being impossible of distinguishing traffic flow patterns" happens in the threshold value filter 1 or 2.

Now, as an example, the rules of the threshold value filter 5 which is composed by adding the additional threshold value filtering function 3 to the threshold value filter 1 will be described.

To a certain threshold value "th" (0<th<1), the increased amount of the threshold value "Δth_inc" (0≦Δth inc<th), and the decreased amount of the threshold value "Δth_dec" (0≦Δth_dec<th):

```
IF      yi ≧ th and yj < th
      {i ∈ (1, . . ., n), j = (1, . . ., n), i ≠ j}
THEN        pat_i = 1
          pat_j = 0
          pat_unspecifiable = 0
          pat_unresolvable = 0
ELSE IF           yi ≧ th and yj ≧ th
          {i, j ∈ (1, . . ., n), i ≠ j}
      THEN IF       yi ≧ th+Δth_inc and yj <th+Δth_inc
                      {i, j ∈ (1, . . ., n), i ≠ j}
                THEN    pat_i = 1
                        pat_j = 0
                        pat_unspecifiable = 0
                        pat_unresolvable = 0
          ELSE      pat_k = 0, {k = (1, . . ., n)}
                      pat_unspecifiable = 1
                      pat_unresolvable = 0
ELSE IF         yi ≧ th − Δth_dec and yj < th − Δth_dec
          {i, j ∈ (1, . . ., n), i ≠ j}
      THEN        pat_i = 1
                pat_j = 0
                pat_unspecifiable = 0
                pat_unresolvable = 0
ELSE      pat_k = 0, {k = (1, . . ., n)}
        pat_unspecifiable = 0
        pat_unresolvable = 1
```

That is to say, in the case where there are two or more output values of the neural network 1BA2 larger than the threshold value "th" and further there are only one output value of the neural network 1BA2 larger than the increased threshold value "th+ Δth_inc", this threshold value filter 5 makes the output value of the filter 1BB1 the value of 1, which output of the filter 1BB1 corresponds to the aforementioned output of the neural network BA2. Thereby, the number of the case of the "being impossible of specifying traffic flow patterns" can be decreased. Furthermore, in the case where the conditions described above are not satisfied and there are one output value of the neural network 1BA2 larger than the decreased threshold value "th–Δth_dec", the threshold value filter 5 makes the output value of the filter 1BB1 the value of 1, which output of the filter 1BB1 corresponds to the aforementioned output of the neural network 1BA2. Thereby, the number of the case of the "being impossible of distinguishing traffic flow patterns" can be decreased.

Next, the additional threshold value filtering function 4 will be described. This function is to do the selection of the traffic flow patterns as follows. That is to say, in the case where there are two or more output values of the neural network 1BA2 larger than the threshold value "th" in the threshold filter 1, or in the case where there are two or more output values of the neural network 1BA2 larger than the threshold value "th1", then if the difference of the outputs of the neural network 1BA2 being larger than the threshold value in each case exceeds another threshold value, the filtering function 4 selects the traffic flow pattern corresponding to the larger neural network output. Thereby, the number of the case of the "being impossible of specifying traffic flow patterns" can be decreased.

Now, as an example, the rules of the threshold value filter 6 which is composed by adding the additional threshold value filtering function 4 to the threshold value filter 1 will be described.

To certain threshold values "th" (0<th<1), "th_gap" (0≦th_gap<1−th):

```
IF          yi ≧ th and yj < th
            {i ∈ (1, . . ., n), j = (1, . . ., n), 1 ≠ j}
  THEN        pat_i = 1
              pat_j = 0
              pat_unspecifiable = 0
              pat_unresolvable = 0
  ELSE IF       yi ≧ th and yj ≧ th
              {i, j ∈ (1, . . ., n), i ≠ j}
      THEN IF           ys = max(yi)    {i °(1, . . ., n)}
                ys − max(yj) ≧ th_gap
                {j ∈ (1, . . ., n), j ≠ s}
                THEN        pat_s = 1
                            pat_j = 0
                            pat_unspecifiable = 0
                            pat_unresolvable = 0
              ELSE      pat_k = 0, {k = (1, . . ., n)}
                      pat_unspecifiable = 1
                      pat_unresolvable = 0
  ELSE        pat_k = 0, {k = (1, . . ., n)}
            pat_unspecifiable = 0
            pat_unresolvable = 1
```

where sign "th_gap" designates the threshold value to the difference between the outputs "yi" larger than the threshold value "th" in the case where there are two or more output values of the neural network 1BA2 larger than the threshold value "th". In the case where there are two or more output values of the neural network 1BA2 larger than the threshold value "th", and further in the case where the difference of them is larger than the threshold value "th_gap", the threshold filter 6 makes the output of the filter 1BB1 the value of 1, which output of the filter 1BB1 corresponds to the larger output among them. Thereby, the number of the case of the "being impossible of specifying traffic flow patterns" can be decreased.

The aforementioned parameters such as the threshold values of the filter 1BB1 can be modified by trial and error or by on-line learning so that the case of the "being impossible of specifying traffic flow patterns" or the "being impossible of distinguishing traffic flow patterns" becomes fewer after the system began to operate.

The traffic flow pattern specifying part 1BB2 in the traffic flow pattern presuming part 1BB specifies one traffic flow pattern from the outputs of the filter 1BBl. Namely, in case of the "pat_i=1" (1≦i≦n), the traffic flow pattern specifying part 1BB2 selects the traffic flow pattern "i" as the output of the traffic flow pattern presuming part 1BB.

In the case where a corresponding traffic flow pattern is selected by the aforementioned procedures (STEP ST33), the selected traffic flow pattern is transmitted to the control parameter setting means 1D as a presumed value (STEP ST34).

Furthermore, in the case where the output of the filter 1BB1 is "pat_j=1" (n<j≦Q), that output designates the state of the "being impossible of specifying traffic flow patterns" or the "being impossible of distinguishing traffic flow patterns". Then a traffic flow pattern cannot selected from the traffic flow pattern memorizing part 1BC (STEP ST33). In that case, one new traffic flow pattern is selected out of the traffic flow database 1CA by the traffic flow selecting part 1CB and is registered to the traffic flow pattern memorizing part 1BC (STEP ST35), and further the learning part 1CC executes the learning in conformity with the procedures like those of the setting of the neural network 1BA2 (STEPs ST13–ST15 in FIG. 7) to correct the neural network 1BA2 (STEP ST36). Such registration of the new traffic flow pattern (STEP ST35) and the correction of the neural network 1BA2 (STEP ST36) are repeated until the determination of the existence of the corresponding traffic flow pattern is made (STEP ST33).

Besides, the selection method of the new traffic flow pattern is that the traffic flow pattern generating the traffic volume data having the smallest distance from the inputted traffic volume data is at first selected and then traffic flow patterns generating the traffic volume data having the smallest distance from the inputted traffic volume data among the residues are successively selected out of the traffic flow database 1BC, where the distance Gdis from the inputted traffic volume data is designated, for example, as follows like in the embodiment 1 stated above:

$Gdist=|G—Gselected|^2$

G: inputted traffic volume data

Gselected: traffic volume data generated by selected traffic flow patterns

The aforementioned is the description of the traffic flow presuming procedures.

Besides, in the case where the capability of the computer executing each procedure in the flowchart of FIG. 15 is limited, the procedures concerning the correction of the neural network 1BA2 (STEPs ST33, ST35, ST36) may be done in one time apart from daily controls, and the selection of the traffic flow patterns may be done by selecting the traffic flow pattern corresponding to the maximum value among the output values y1, ..., yn of the neural network 1BA2. In this selection, if there are plural traffic flow patterns corresponding to the maximum value among the output values y1, ..., yn, one of them may be selected randomly, or one having higher frequency of having been selected in the past during the same time zone may be selected.

EMBODIMENT 3

Next, another method of the elevator group supervisory control different from that of the embodiment 1 will be described as the third embodiment of the present invention.

Figure 16A:
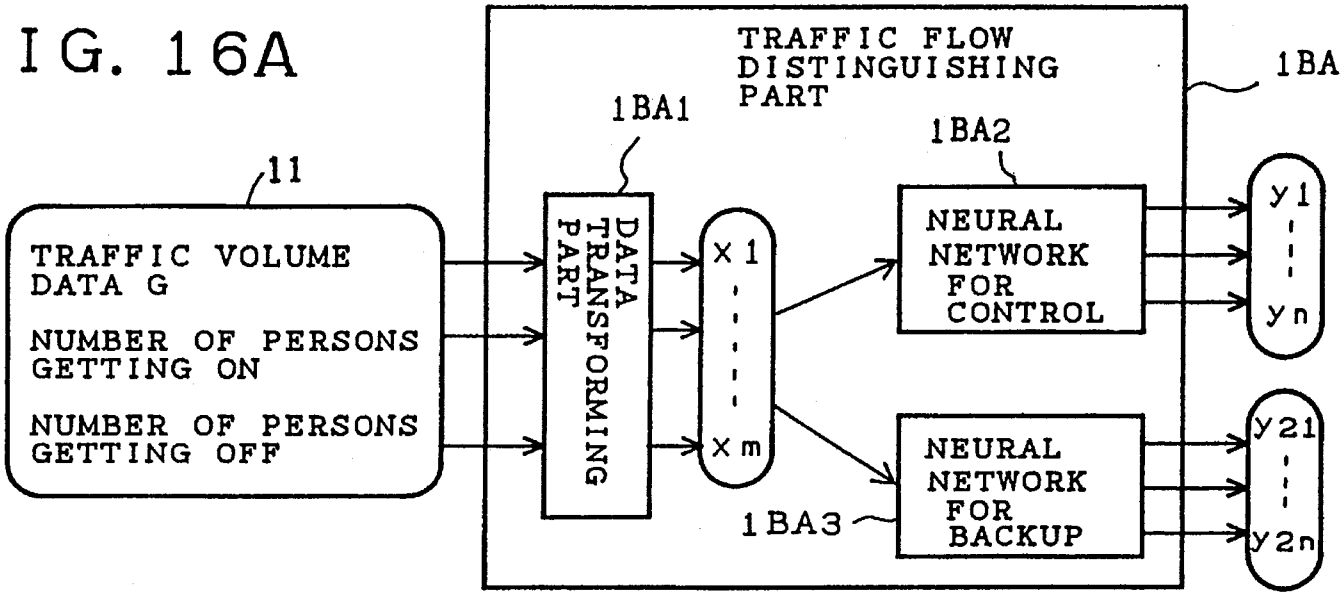
FIGS. 16A and 16B are functional block diagrams showing an example of constructions of the traffic flow distinguishing part and the traffic flow pattern memorizing part of the embodiment 3 of the present invention.
Figure 16B:
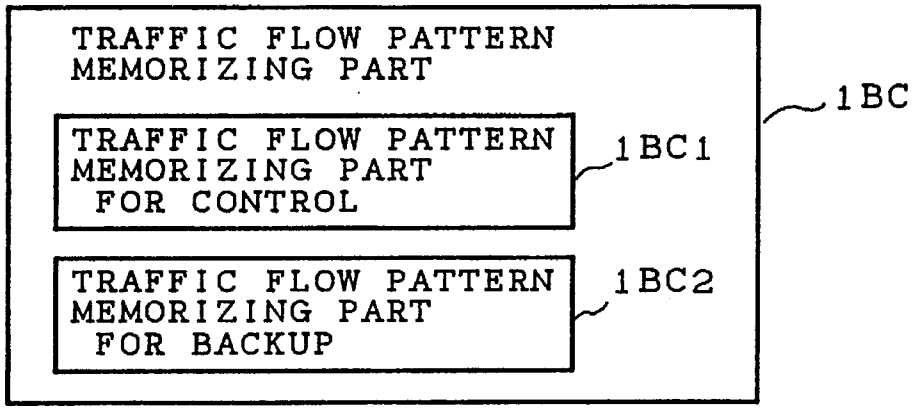

The construction of the traffic means controlling apparatus of this embodiment 3 is basically identical to that of the embodiment 2 (FIG. 3), accordingly the description concerning the basic construction of the embodiment 3 will be omitted. Provided that, in this embodiment 3, the traffic flow distinguishing part 1BA comprises a neural network for control 1BA2 and a neural network for backup 1BA3, and the traffic flow pattern memorizing part 1BC also comprises a traffic flow pattern memorizing part for control 1BC1 and a traffic flow pattern memorizing part for backup 1BC2. These are the different points from the corresponding sections of the embodiment 2. FIGS. 16A and 16B are functional block diagrams showing the functional construction of the traffic flow distinguishing part 1BA and the traffic flow patterns memorizing part 1BC of the embodiment 3.

Figure 17:
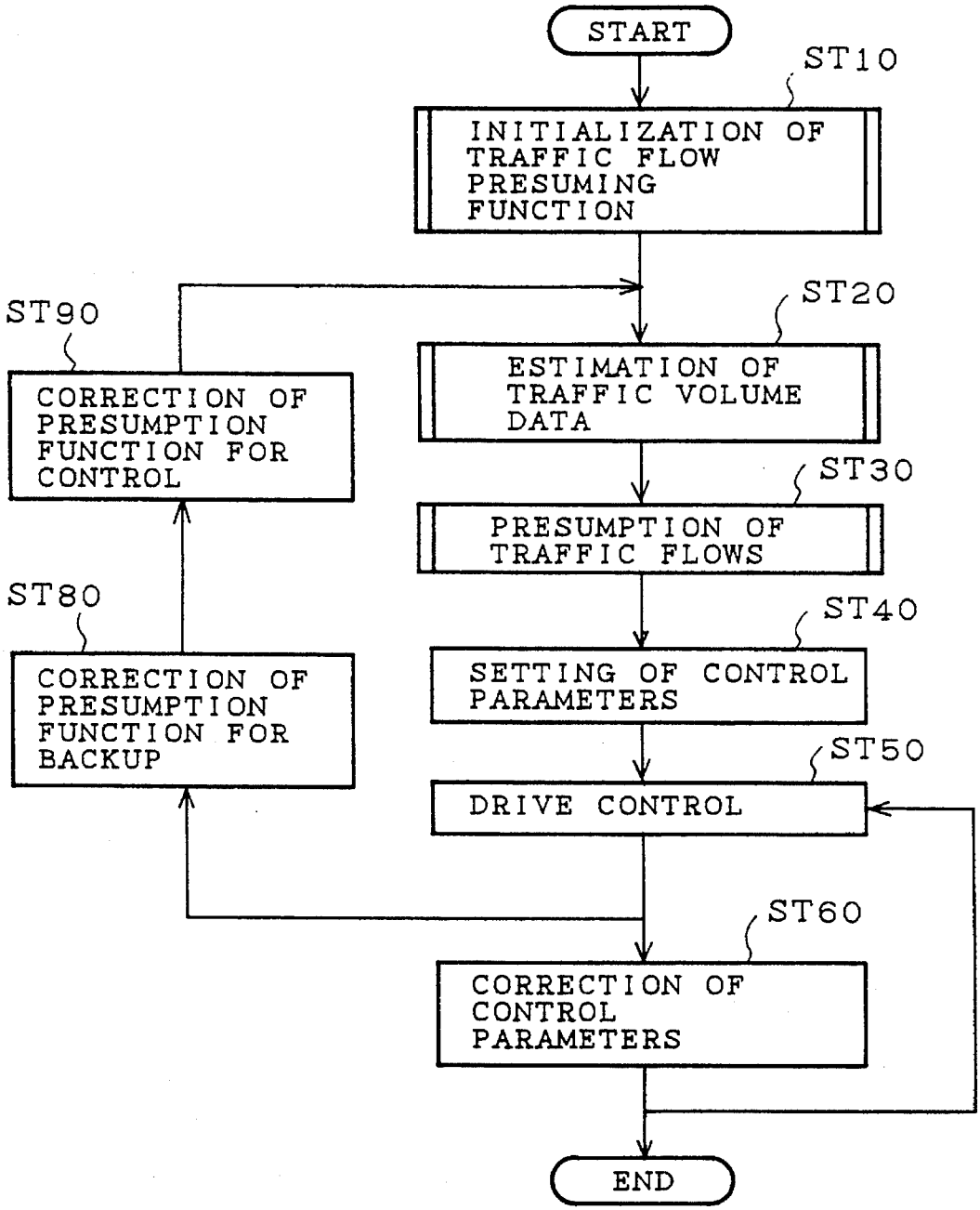
FIG. 17 is a flowchart showing the operation of the embodiment 3 of the present invention.

Next, the operation will be described thereof. FIG. 17 is a flowchart showing the elevator group supervisory control procedures of the embodiment 3. In FIG. 17, processing steps identical to those of the embodiment 2 are numbered by the use of the same step numbers as those of the corresponding steps of FIG. 6.

At first, before beginning the control, the presuming function of the traffic flow presuming means 1B is initialized (STEP ST10). In the initialization procedure of the presuming function, the initialization of the neural network of the traffic flow distinguishing part 1BA in the traffic flow presuming means 1B and the registration of appropriate number of traffic flow patterns to the traffic flow pattern memorizing part 1BC are executed in conformity with the procedure shown in FIG. 7 like that of the embodiment 1. Provided that there are two kinds of the neural networks and the traffic flow pattern memorizing parts respectively in this embodiment 3, however the neural network for control 1BA2 and the neural network for backup 1BA3, and the traffic flow pattern memorizing part for control 1BC1 and the traffic flow pattern memorizing part for backup 1BC2 are respectively set to be quite equal in this initializing procedure (STEP ST10) in advance.

Next, in FIG. 17, as the elevator group supervisory controlling procedure on the day when the control is executed, the traffic volume detecting apparatus 1F detects the traffic volumes on the day in real time at first, and the traffic flow estimating means 1A samples the detected traffic volumes. Thereby, traffic volumes G in the near future are estimated in real time (STEP ST20). These procedures are also the same as those of the embodiment 2.

Next, traffic flows are presumed from the traffic volume data G estimated by the traffic volume estimating means 1A (STEP ST30 in FIG. 17). This traffic flow presumption is executed in conformity with the procedures of FIG. 15 like that of the embodiment 1. The control operation in this procedure is only executed by the use of the neural network for control 1BA2 in the traffic flow distinguishing part 1BA and the traffic flow pattern memorizing part 1BC1 in the traffic flow pattern memorizing part 1BC.

Next, in FIG. 17, after the presumption of a traffic flow was done in STEP ST30, control parameters are set by the control parameter setting part 1DA (STEP ST40), and the drive control means 1E executes drive control in accordance with the set control parameters (STEP ST50). Then, the control results of the group supervisory control and the drive results of each elevator are detected by the control result detecting means 1G, and the control parameters are corrected by the control parameter correcting part 1DC in the control parameter setting means 1D, which received the control results and the drive results, by the use of the on-line tuning method or the off-line tuning method (STEP ST60). These procedures of STEPs ST40–ST60 are executed similarly to those of the embodiment 1.

Furthermore, the correction of the traffic flow presuming function for backup is periodically done apart from this daily control (STEP ST80 in FIG. 17). This correction step ST80 is done in conformity with the procedure of FIG. 9 similar to STEP ST70 of FIG. 6 in the embodiment 1. This correction is done only to the neural network for backup 1BA3 of the traffic flow distinguishing part 1BA and the traffic flow pattern memorizing part for backup 1BC2 of the traffic flow pattern memorizing part 1BC, and the correction to the neural network for control 1BA2 and the traffic flow pattern memorizing part for control 1BC1 are not done.

Then, the evaluations of the traffic flow presuming functions of the neural network for control 1BA2 and the neural network for backup 1BA3 are done by the use of each of them respectively on a day other than the day when the correction of STEP ST80 was done, and if it is determined that the traffic flow presuming function using the neural network for backup 1BA3 is superior to that using the neural network for control 1BA2, the neural network for control 1BA2 and the traffic flow pattern memorizing part 1BC1 are corrected by duplicating the contents of the neural network for backup 1BA3 and the traffic flow pattern memorizing part for backup 1BC2 to the neural network for control 1BA2 and traffic flow pattern memorizing part for control 1BC1 or by replacing the contents of the neural network for control 1BA2 and the traffic flow pattern memorizing part for control 1BC2 with the contents of the neural network for backup 1BA3 and the traffic flow pattern memorizing part for backup 1BC1 respectively (STEP ST90).

The evaluations of the presuming functions on the basis of the two kinds of the neural networks may be done for instance as follows.

At first, the actual traffic volume data having been detected by the traffic volume detecting means 1F in the past, the control results E having actually been controlled, and the presumption results Tc having used the neural network for control 1BA2 are previously monitored, then the presumption based on the detected actual traffic volume data is done by the use of the neural network for backup 1BA3, and the presumption results are designated by sign Tb. Because the control results to these presumption results Tc, Tb on the basis of each control parameter are memorized in the traffic flow database 1CA, the control results (hereinafter referred to as Ec and Eb) on the basis of actually used control parameters are then taken out of them.

Then these control results Ec, Eb are compared with the actually observed control result E. For instance, distances $|E-Ec|^2$, $|E-Eb|^2$ may be used in this comparison of the control result E and the control result Ec and the comparison of the control result E and the control result Eb.

Accordingly, if the control result Eb of the presumption result Tb is more similar to the control result E than the control result Ec, it is determined that the presumption result using the neural network for backup 1BA3 was a better presumption result. The comparisons stated above are executed to the every monitored datum, then if the frequency of the determination that the presumption result using the neural network for backup 1BA3 is better is high, the neural network for control 1BA2 and the traffic flow pattern memorizing part for control 1BC1 are corrected by duplicating the contents of the neural network for backup 1BA3 and the traffic flow pattern memorizing part for backup 1BC2 to the neural network for control 1BA2 and the traffic flow pattern memorizing part for control 1BC1 or by replacing the contents of the neural network for control 1BA2 and the traffic flow pattern memorizing part for control 1BC1 with the contents of the neural network for backup 1BA3 and the traffic flow pattern memorizing part for backup 1BC2 respectively.

Because a neural network having a better presumption function is always being preserved by keeping executing the correction in conformity with the method mentioned above, the presumption accuracy of the traffic flow presuming function can be kept in a good state.

EMBODIMENT 4

Next, the application of the present invention especially to the signal control in road traffic will be described as the fourth embodiment of the present invention.

Figure 18:
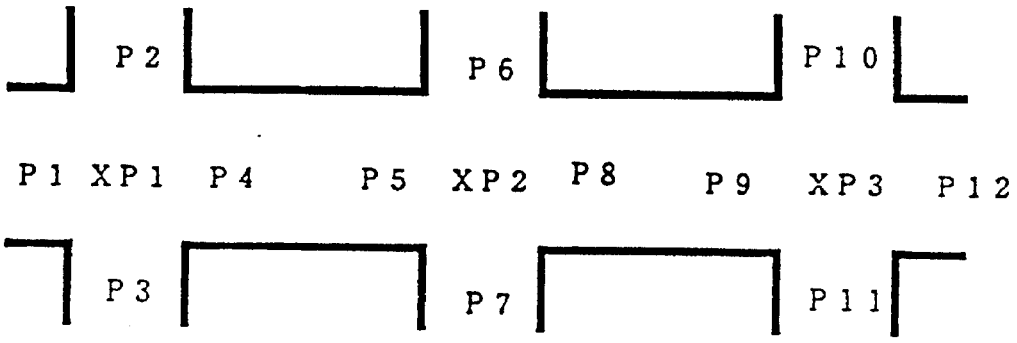
FIG. 18 is an explanatory drawing for showing an example of the settings of the control parameters of the road traffic control in the embodiment 4 of the present invention.

FIG. 18 is an explanatory drawing typically depicting an arterial road having plural intersections. In FIG. 18, reference signs XP1–XP3 designate intersections of the arterial road; and numerals P1–P11 designate points showing entrance and exits.

Generally, the signal control in the arterial road shown in FIG. 18 is executed by observing the following traffic volume data, for instance.

traffic volume datum: G=(Nin, Nout)

Nin: the number of inflow cars at each inflow point

Nout: the number of outflow cars at each outflow point

Besides, the traffic flow flowing in or out the arterial road in FIG. 18, for example, can be expressed as follows.

traffic flow datum: T=(T12, T13, ..., Tij, ...)

Tij: the number of cars flowing in from the "i" point and flowing out from the "j" point for a specified time Moreover, for example the following data are observable in regard to control results apart from the traffic volume data.

control result: E=(m, v, 1)

m: the number of passing cars at a point v: the passing velocity at a point

1: the length of the traffic snarl at a point

The traffic means controlling apparatus having functions basically equivalent to those of the embodiment 1 (equivalent to the functions shown in FIG. 4) makes it possible to presume the traffic flow data T from the traffic volume data G in road traffic, and makes it possible to construct and correct the presuming functions from the traffic volume data G, the traffic flow data T and the control results E in road traffic by the use of the relationships of "traffic flow patterns, control results". Accordingly, the description of the detail of the procedures of the presumption of traffic flows and the construction and correction of the presuming functions will be omitted, and the setting of control parameters and the control procedures will be described hereinafter.

For example, the following control parameters are used in the signal control of road traffic.

cycle: the time of making a round of blue →yellow →red split: the ratio of blue in a cycle [%]

offset: the difference between the beginning times of each cycle at adjoining intersections right-turn aspect time: the displaying time of the arrow signal indicating right-turn Hereinafter, the setting of these control parameters will be described with examples.

Generally, the parameters "cycle" and the "split" of the signal control parameters are set on the basis of the numbers of cars flowing in, the rates of cars mixed in with turning to the right and the rates of cars mixed in with turning to the left at each point surrounding the intersection where a signal is installed as the following equations. Now, signs f1, f2 in the following equations designate well known functions.

C=f1 (Nin, R, L)

S=f2 (Nin, R, L)

C: cycle

S: split

Nin: the number of cars flowing in each point

R: the rates of cars mixed in with turning to the right at each point

L: the rates of cars mixed in with turning to the left at each point

Conventionally, for example the number of cars Nin flowing in intersections XP1–XP3 from each point P1–P12 could be observed with the traffic volume data G, but it was impossible to recognize the data such as the number of cars going straight on, turning to the right or turning to the left, and consequently, it was required to measure the rates of turning to the right or the left with human hands at the points where signals are installed in advance.

But, the rates of turning to the right or to the left at each intersection can easily obtained by obtaining the traffic flows, herein appearances and movements of cars expressed by the elements such as time, places, directions and the like by means of the present invention, then they need not be measured previously.

Besides, the "offset" among the control parameters denotes the beginning time difference between the cycles of the intersections XP1–XP3 adjoining each other in the arterial road, and adjusting this "offset" properly would make it possible that, for example, a car having passed the intersection XP1 uninterruptedly pass the intersections XP2, XP3 in the blue signal. If the traffic flows between intersections can be obtained, appropriate "offsets" can be set by grasping the degrees of the congestion between intersections exactly.

Next, the time of the arrow signal indicating right-turn among the control parameters will be described.

Figure 19:
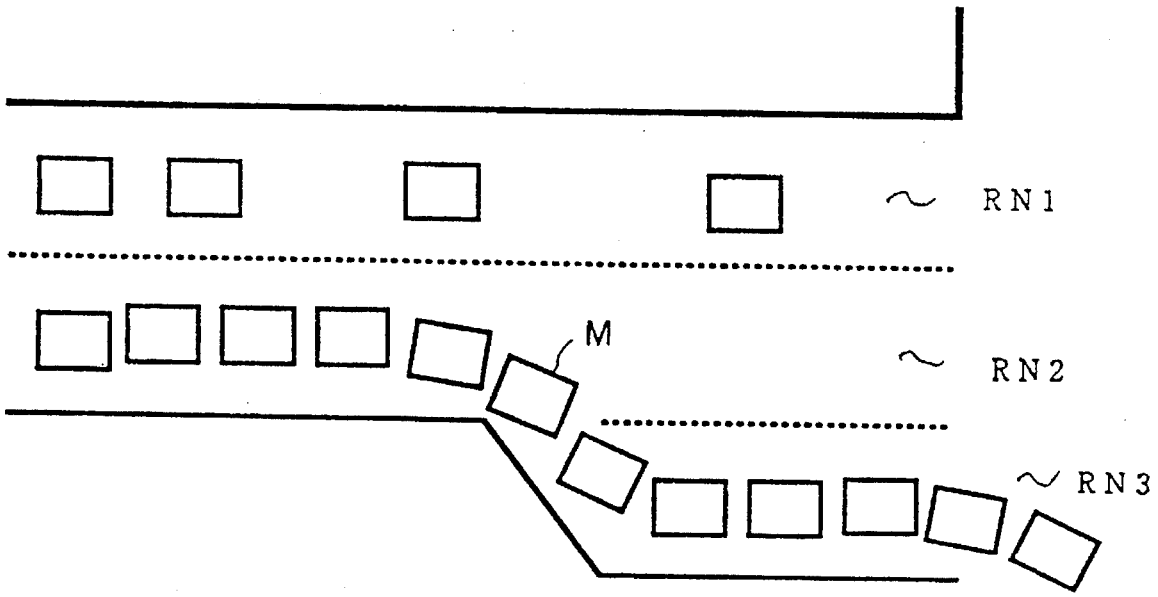
FIG. 19 is an explanatory drawing for showing another example of the settings of the control parameters in the embodiment 4 of the present invention.

FIG. 19 is an explanatory drawing typically showing an arterial road having a lane dedicated to cars turning to the right. In FIG. 19, reference signs RN1, RN2 designate lanes for cars going straight on; sign RN3 designates the lane dedicated to cars turning to the right; and sign M designates a car.

There frequently happen the cases where cars waiting to turn to the right in an intersection or before the place of the intersection are obstacles for the following cars to pass and the cars brings about traffic snarls in road traffic. In particular in the case where cars waiting to turn to the right are ranged longer than the length of the lane dedicated to the cars turning to the right as shown in FIG. 19, a heavy traffic snarl is caused in high probability.

In such a road, too, because the number of cars turning to the right per unit time at each intersection can easily obtained when traffic flows, herein the appearances and the movements of cars expressed by the elements such as time, places, directions and the like are obtained, the time of the arrow signal indicating right-turn can be set in accordance with the number of cars turning to the right more efficiently than in prior arts similarly in the case of setting the aforementioned "cycle" and "split".

Furthermore, the regulation of traffic or the setting of dedicated lanes such as the designation of the right side lane RN3 as the lane dedicated to the cars turning to the right, designation of the left side lane RN1 as the lane dedicated to the cars turning. to the left, and the like can be determined efficiently.

Moreover, similarly to the embodiment 1 mentioned above, it is possible to previously set the optimum control parameters by simulations in regard to previously prepared traffic flow patterns. Accordingly, since traffic flow data can be presumed from traffic volume data by means of the present invention, the optimum control parameters can automatically be set, also the control parameter can be corrected in accordance with control results similarly to in the embodiment 1.

EMBODIMENT 5

Next, as the fifth embodiment of the present invention, the application of the invention especially to the execution of train group control in railways will be described.

Figure 20:
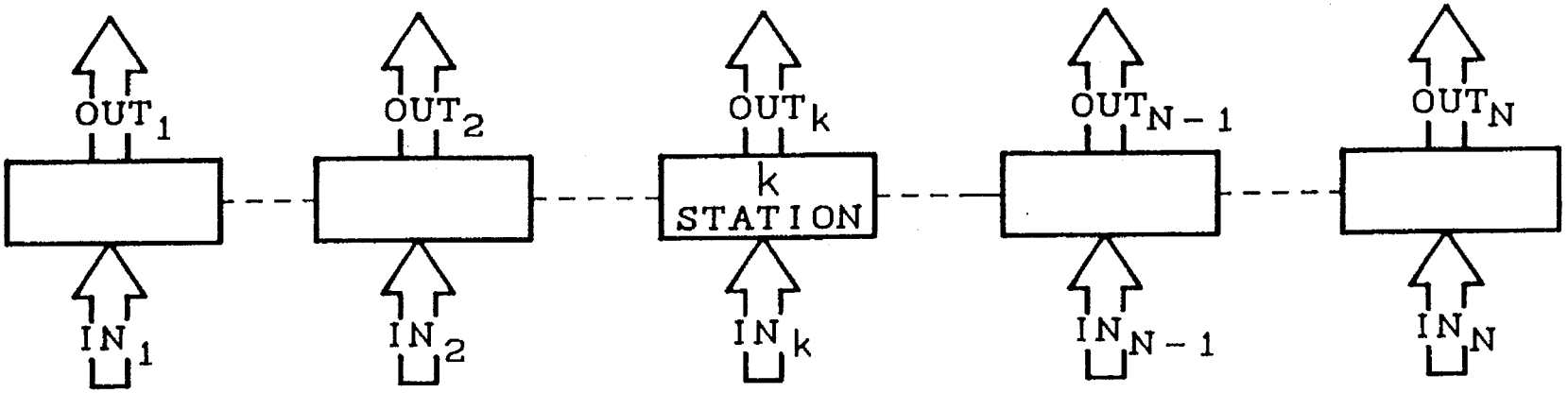
FIG. 20 is an explanatory drawing for explaining the control of railways in the embodiment 5 of the present invention.

FIG. 20 is an explanatory drawing showing the entrance and exit of users at each station. In FIG. 20, reference signs IN1– INn designates the number of persons entering each station; signs OUT1–OUTn designate the number of persons exiting from each station.

In case of railways, the following numbers of persons entering and exiting from each station are observable traffic volume data as shown in FIG. 20.

traffic volume data: G = (IN, OUT)
IN = {INk}
OUT = {OUTk}
INk: the number of persons entering k-station from its wickets in a certain time zone
OUTk: the number of persons exiting from the wickets of k-station in a certain time zone Then, the traffic flow data to be presumed can be set for instance as follows.

traffic flow data: T={Tij}

Tij: the number of passengers getting on at i–station and getting off at j-station in a certain time zone Furthermore, as to control results, for instance the following data are observable, apart from traffic volume data.

control results: E=(s, r)

s: stopping time at a station r: rail time between stations

Constructing a traffic means controlling apparatus basically having equal functions to the aforementioned embodiment 1 (equal to those shown in FIG. 4) makes it possible to presume the traffic flow data T from the traffic volume data G in the train group control of railways, and makes it possible to construct and correct the presuming functions from the traffic volume data G, the traffic flow data T and the control results E in the train group control of railways by the use of the relationship of "traffic flow patterns, control results".

Accordingly, the description of the detail of the procedures of the presumption of traffic flows, and the construction and the correction of the presuming functions will be omitted, and the description as to the setting of the control parameters and the control procedures will be made hereinafter.

In railways, each train is operated in conformity with a previously determined operation diagram, actually it often happens that stoppage time is elongated longer than the scheduled time, for example, at a rush-hour in the morning because of the increasing of passengers getting on and off. In such a case, it is needed to operate the train group smoothly by uniformizing headways by adjusting the stoppage time and the rail time of each train, or by omitting train stoppage between stations.

For example, at the time when it is estimated that the stoppage time of a train TR at k-station will be elongated longer than a scheduled time, the headway between the train TR and the following train to the train TR is controlled so as not to be shortened. Moreover, the headway between the train TR and the preceding train to the train TR is also controlled so as not to be enlarged.

But each train gradually comes to be behind the operation diagram in case of being operated in conformity with such a control method. Accordingly, it is required to control the trains so as to get back the delayed time by shorten the stoppage time of a retarded train if the headways between the retarded train and each train of the preceding train and the following train are within a specified range at the time when it is estimated that the stoppage time of the retarded train at a certain station will be shorter than the scheduled time, and further it is required to control the rail time of the retarded train so as to be shorten as much as possible if the headways between the retarded train and each train of the preceding train and the following train are within a specified range similarly.

The accurate presumption of the stoppage time of each train is required for executing such control. As for the stoppage time, it can be determined according to the time required for getting on and off. The time required for getting on and off can be presumed by a well known method if the number of persons having gotten on a train and the number of persons getting on and off is known.

In contrast to this, only the number of persons entering and exiting from a station per a unit time can be known from traffic volume data conventionally, and consequently, the number of persons getting on and off of each train cannot presume in the prior art becauseof being impossible of knowing each passenger's destinations.

Accordingly, a method of presumption of the number of passengers in a train by measuring the degrees of the congestion of each train periodically by the use of human eyes is taken. The method of measuring the stoppage time of each train by a man also taken, however it is not effective to utilize these measurement results for the estimation of the stoppage time because the stoppage time is greatly influenced by the numbers of persons getting on and getting off each train.

However, using the traffic flow data presumed by means of the present invention enables calculating the numbers of passengers to each destination per unit time at each station, and consequently, the numbers of persons getting off and on each train at each station can be obtained, and the presumption of the time for getting on and off from the numbers of persons getting on and off each train becomes capable. Thereby, it is not necessary to periodically execute the observation of the degrees of congestion with human eyes and the measurement of stoppage time, which are troublesome. And using the stoppage time presumed by such a method enables accurately determining the amount of the adjustments of the stoppage time and rail time. Consequently, train group can be controlled so as to be operated more smoothly.

Moreover, similarly to the embodiment 1, it is possible to previously set the optimum control parameters by simulations in regard to previously prepared traffic flow patterns. Accordingly, since traffic flow data can be presumed from traffic volume data, the optimum control parameters can automatically be set, also the control parameters can be corrected in accordance with control results similarly in the embodiment 1.

Furthermore, the traffic data presumed in conformity with the present invention and corrected for a specified term and further processed by means of statistical treatment can be utilized as the data for determining stoppage time and stopping stations on train operation diagrams.

Figure 21:
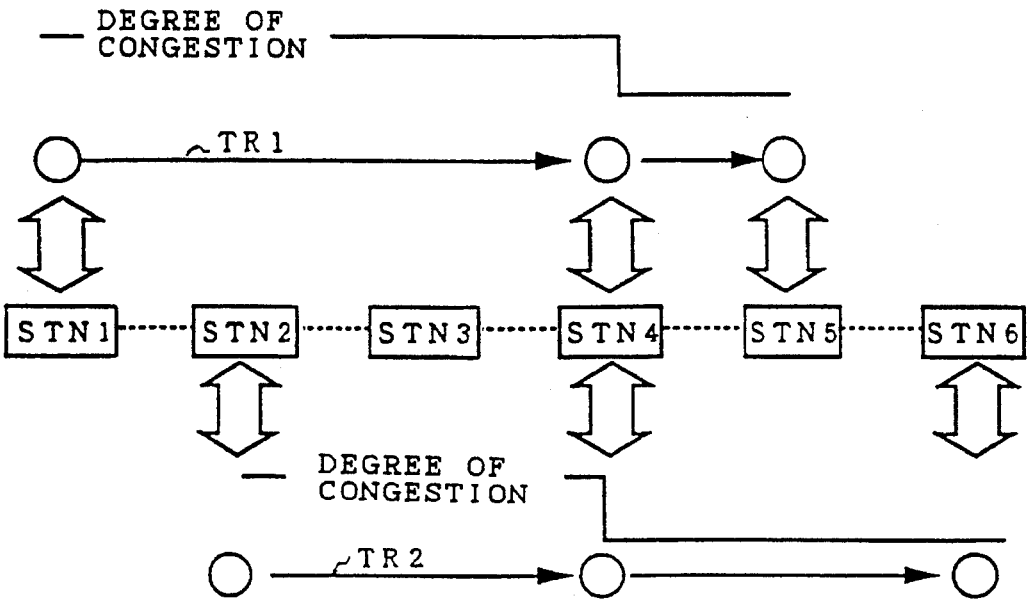
FIG. 21 is an explanatory drawing for showing an example of the settings of the control parameters in the embodiment 5 of the present invention.

FIG. 21 is an explanatory drawing showing the numbers of getting on and off trains at each station. In FIG. 21, reference signs STN1–STN6 designate stations; and signs TR1, TR2 designate trains. Also, arrows pointing upwards and downward designate the getting on and off of passengers; and circular marks designate stations at which the trains stop.

As an example, a decision problem of the stoppage time of the train TR1 stopping the stations STN1, STN4, STN5 and the train TR2 stopping the stations STN2, STN4, STN6 at each station of the five stations will be considered.

Conventionally, the numbers of persons getting on and off each train and the time of getting on and off each train cannot be presumed as mentioned above. Besides, although it is possible to measure actual stoppage time, there are cases where actually measured values are not reliable or they do not exist at all when operation diagrams are newly drawn up. Consequently, stoppage time could not but be determined with actual operation results in past and the like, and there were no methods especially to determine the stoppage time of the different kinds of trains (for instance, an express train and a local train) at the same station.

However, the usage of the traffic flow data presumed by means of the present invention enables obtaining the numbers of passengers of each train and the numbers of persons getting on and off each train.

For instance, in the case where the number of passengers moving between each station in a certain time zone is as follows:

T14=1000: the number of passengers having got on the station STN1 and getting off the station STN4

T24=1500: the number of passengers having got on the station STN2 and getting off the station STN4

T45=700: the number of passengers having got on the station STN4 and getting off the station STN5

T46=800: the number of passengers having got on the station STN4 and getting off the station STN6 the numbers of persons getting on and getting off the trains TR1, TR2 and the numbers of passengers of the trains TR1, TR2 at the station STN4 can be presumed to be:

train TR1: the number of persons getting on=700, the number of persons getting off=1000, the number of passengers=1000 train TR2: the number of persons getting on=800, the number of persons getting off=1500, the number of passengers=500 then it is made to be possible to set the appropriate stoppage time of each of the train TR1 and the train TR2 by presuming the time necessary to getting and off on the basis of the aforementioned data by the use of well known methods.

Figure 22:
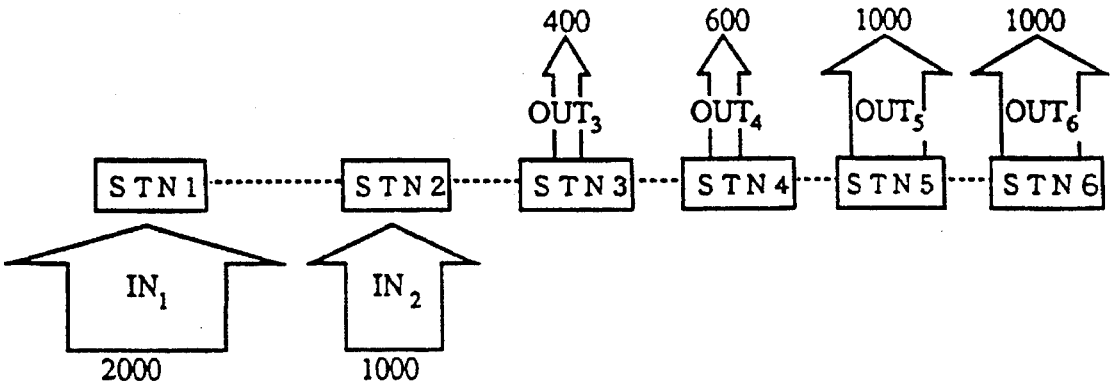
FIG. 22 is an explanatory drawing for showing another example of the settings of the control parameters in the embodiment 5 of the present invention.

Besides, FIG. 22 is an explanatory drawing showing the number of persons entering or exiting from each station. Ih FIG. 22, reference signs IN1, IN2 and reference signs OUT3–OUT6 respectively designate the number of persons entering each of the stations STN1, STN2 and the number of persons exiting from each of the stations STN3–STN6.

As an example, a problem concerning drawing up an operation diagram which includes a new determination of stations where express trains stop in a morning time zone on the route composed of six stations STN1–STN6 shown in FIG. 6 will be considered.

There are many persons who commute from the direction of the station STN1 to the direction of the station STN6 in a morning time zone on this route. Supposing that the observed results of the numbers of persons entering and exiting from each station were as follows:

IN1=2000: the number of persons entering the station STN1

IN2=1000: the number of persons entering the station STN2

OUT5=1000: the number of persons exiting the station STN5

OUT6=1000: the number of persons exiting the station STN6

OUT3=400: the number of persons exiting the station STN3

OUT4=600: the number of persons exiting the station STN4.

That is to say, any of the numbers of persons entering the stations STN1, STN2 and the numbers of persons exiting from the stations STN5, STN6 are extremely large, and the numbers of the persons exiting from the stations STN3, STN4 are in ordinary extent. Because exact traffic flow data could not be obtained in such a case conventionally, the following procedure were taken. Namely, an operation diagram by which express trains stop at the stations STN1, STN2, STNS, STN6 and local trains stop at all of the stations was drawn up on the basis of the numbers of persons entering and exiting from each station by way of experiment at first, then the provisional operation diagram was step by step changed by the use of the methods of observing the degrees of the congestion of each train by men and the like after carrying out the operation diagram.

But, such methods of drawing up operation diagrams have following defects.

* The good operation diagram cannot be carried out from the beginning.

* The evaluation of operation diagrams are made by men qualitatively.

On the other hand, supposing that traffic flow data was presumed by means of the present invention and a result that there were many cases where mainly the passengers entering the station STN1 and exiting from the stations STN5, STN6 and the passengers entering the station STN2 and exiting the stations STN3, STN4 was obtained. That is to say, for example the following data are provisionally obtained.

T15=1000: the number of the passengers getting on at the station STN1 and getting off at the station STN5

T16=1000: the number of the passengers getting on at the station STN1 and getting off at the station STN6

T23=400: the number of the passengers getting on at the station STN2 and getting off at the station STN3

T24=600: the number of the passengers getting on at the station STN2 and getting off at the station STN4

Then, it can be known from these presumption results that the operation diagram ought to be drawn up so that the stations STN1, STN5, STN6 should be set to be the stations where all kinds of trains, including express trains, stop and the other stations should be set to be the stations where only local trains stop. Moreover, as for the evaluation value of the operation diagram in this case, traffic flow data may be used, and the data make it possible to calculate the degrees of the congestion of trains over the whole route and the total necessary time of passengers' movements quantitatively.

Consequently, the following merits can be obtained by carrying out the operation diagram drawn up as mentioned above actually, and by presuming traffic flow data in accordance with the present invention, and further by changing the operation diagram by means of re-evaluating the operation diagram by the use of the aforementioned evaluation value.

* The operation diagram being good to some extent can be carried out from the beginning.

* The evaluation of the operation diagram can be made quantitatively.

It will be appreciated from the foregoing description that, according to the first aspect of the present invention, the traffic means controlling apparatus is provided with a traffic flow presuming means presuming traffic flows from traffic volumes, and a presumption function constructing means constructing and correcting the presumption function of the traffic flow presuming means, and the traffic means controlling apparatus is constructed to set control parameters for controlling traffic means in accordance with the presumed traffic flows by the traffic flow presuming means with the control parameter setting means, and consequently, the traffic means controlling apparatus brings about the effects that the movement states of passengers including moving directions can be recognized from traffic volumes, and that traffic flows can be presumed more accurately, furthermore, that appropriate control parameters can be set or corrected, and that traffic means can be efficiently controlled.

Furthermore, according to the second aspect of the present invention, the traffic means controlling apparatus is constructed to operates the relationships between traffic volumes and traffic flows by the use of a neural network to presume traffic flows from traffic volumes, and consequently, the traffic means controlling apparatus brings about an effect that traffic flows can be presumed without complicated logical operations or arithmetic processings.

Furthermore, according to the third aspect of the present invention, the traffic means controlling apparatus is constructed to construct and correct the presuming function of a traffic flow presuming means by constructing an appropriate neural network by making it learn arbitrarily selected plural relationships among many relationships between traffic flow patterns and traffic volumes and by correcting the neural network by making it re-learn the information of the newly selected relationships between traffic flow patterns and traffic volumes on the basis of the traffic flows presumed from actually measured traffic volumes and their controlled results, and consequently, the traffic means controlling apparatus brings about an effect that the traffic flows corresponding to inputted traffic volumes can be presumed more accurately.

Furthermore, according to the fourth aspect of the present invention, the traffic means controlling apparatus is provided with a neural network for control and a neural network for backup and is constructed to presume traffic flows for daily traffic means control with the neural network for control, and to presume traffic flows periodically with the neural network for backup, and to compare and evaluate the presumption results of the traffic flows of the two kinds of neural networks with a presumption function constructing means, and to correct the neural network for control by replacing the contents of the neural network for control with the contents of the neural network for backup or by duplicating the latter to the former when the presumed results of the neural network for backup are determined to be superior to the presumed results of the neural network for control, and consequently, the traffic means controlling apparatus brings about an effect that the presumption accuracy of the traffic flow presuming function can always be kept good.

Furthermore, according to the fifth aspect of the present invention, the traffic means controlling apparatus is constructed to presume traffic flow patterns from the outputvalues of a neural network in a traffic flow distinguishing part by filtering the output values of the neural network, and consequently, the traffic means controlling apparatus brings about an effect that the traffic flow pattern having the highest similarity can easily be detected out of plural neural network output values.

Furthermore, according to the sixth aspect of the present invention, the traffic means controlling apparatus is constructed to presume traffic flow patterns from the output values of the neural network in a traffic flow distinguishing part by the use of an additional function in the filtering of the output values of the neural network, and consequently, the traffic means controlling apparatus brings about an effect that the traffic flow presuming function can be further improved.

Furthermore, according to the seventh aspect of the present invention, the traffic means controlling apparatus is constructed to detect control results showing the controlled states by traffic means and drive results showing the actions of the traffic means with the control result detecting means, and consequently, the traffic means controlling apparatus brings about an effect to be able to set values with which the optimum control results can be obtained as control parameters for controlling traffic means. Furthermore, according to the eighth aspect of the present invention, the traffic means controlling apparatus is constructed to correct the standard values of control parameters by setting the standard values in accordance with traffic flows presumed by a traffic flow presuming means with the control parameter setting means, and by executing off-line tuning on the basis of control results and drive results detected by a control result detecting means, and consequently, the traffic means controlling apparatus brings about effects that the control parameters can be corrected according to individual time zones even if errors between the actual movements of passengers or the like and the presumed traffic flows happen at the individual time zones, and that more suitable control results for the control of traffic means can be obtained.

Furthermore, according to the ninth aspect of the invention, the traffic means controlling apparatus is constructed to correct control parameters by detecting control results or drive results in real time with a control result detecting means, and by setting the standard values of control parameters on the basis of presumed traffic flows by a traffic flow presuming means with a control parameter setting means, and further by executing on-line tuning in accordance with the control results or the drive results detected by the control result detecting means, and consequently, the traffic means controlling apparatus brings about effects that the control parameters can be corrected in response to errors which would happen between the actual movements of passengers or the like and presumed traffic flows over all time zones, and that more suitable control results for the control of traffic means can be obtained.

Furthermore, according to the tenth aspect of the present invention, the traffic means controlling apparatus is constructed to output control results and drive results detected by a control result detecting means to a manager and to set or corrects control parameters in response to the directions of the manager with the user interface, and consequently, the traffic means controlling apparatus brings about an effect that the manager can lead out and set appropriate control parameters efficiently.

Furthermore, according to the eleventh aspect of the present invention, the traffic means controlling apparatus is constructed to estimates traffic volumes in real time from the time when traffic volumes are detected by executing the sampling processing of the traffic volumes .detected in real time, and consequently, the traffic means controlling apparatus brings about an effect that the presumption of traffic flows on the basis of traffic volume data having better estimation accuracy becomes capable.

While preferred embodiments of the present invention have been described using specific terms, such description is for illustrative purposes only, and it is to be understood that changes and variations may be made without departing from the spirit or scope of the following claims.

What is claimed is:

1. A traffic controlling apparatus for a transportation system having traffic and traffic controllers, said traffic controlling apparatus comprising:

a traffic volume detecting means for detecting traffic volumes in the transportation system;

a traffic flow presuming means for presuming traffic flows from the traffic volumes detected by said traffic volume detecting means;

a presumption function constructing means constructing and correcting a presumption function of said traffic flow presuming means;

a control result detecting means for detecting control results and drive results of the transportation system; and a control parameter setting means for setting control parameters that control said traffic controllers on the basis of the traffic flow determined by the traffic flow presuming means, the control results, and the drive results.

2. The traffic controlling apparatus according to claim 1, wherein said traffic flow presuming means includes a neural network which determines relationships between traffic volumes and traffic flows.

3. The traffic controlling apparatus according to claim 2, wherein said presumption function constructing means includes a plurality of relationships between traffic flow patterns and traffic volumes, and constructs said neural network by using arbitrarily selected plural relationships among said relationships, and further corrects said neural network by using newly selected relationships between traffic flow patterns and traffic volumes on the basis of traffic flows presumed from actually measured traffic volumes and controlled results.

4. The traffic controlling apparatus according to claim 2, wherein said traffic flow presuming means further includes a backup neural network which periodically determines relationships between traffic volumes and traffic flows, and wherein said presumption function constructing means compares and evaluates results of said neural network and results of said backup neural network and replaces contents of said neural network with contents of said backup neural network when the results of said backup neural network are superior to the results of said neural network.

5. The traffic controlling apparatus according to claim 2, wherein said traffic flow presuming means includes a traffic flow distinguishing means for distinguishing traffic flows corresponding to traffic volumes by using said neural network, and a first filtering means for filtering the traffic flows distinguished by said traffic flow distinguishing means.

6. The traffic controlling apparatus according to claim 5, wherein said traffic flow presuming means further includes a second filtering means complementing said first filtering means.

7. The traffic controlling apparatus according to claim 1, wherein said control parameter setting means corrects said control parameters by setting standard values of the control parameters in accordance with traffic flows presumed by said traffic flow presuming means, and by executing off-line tuning of the standard values on the basis of the control results and the drive results detected by said control result detecting means.

8. The traffic controlling apparatus according to claim 1, wherein said control result detecting means detects control results and drive results in real time, and wherein said control parameter setting means corrects said control parameters by setting standard values of said control parameters in accordance with traffic flows presumed by said traffic flow presuming means, and by executing on-line tuning of the standard values on the basis of the control results and the drive results detected by said control result detecting means.

9. The traffic controlling apparatus according to claim 1 further comprising a user interface for outputting the control results and the drive results detected by said control result detecting means and for setting said control parameters in response to directions of a user.

10. The traffic controlling apparatus according to claim 1 further comprising a traffic volume estimating means for estimating traffic volumes for prescribed time periods from traffic volumes detected by said traffic volume detecting means.

11. A traffic controlling apparatus for a transportation system having traffic and traffic controllers, said traffic controlling apparatus comprising:

a traffic volume detecting means for detecting traffic volumes in the transportation system;

a traffic flow presuming means for presuming traffic flows from the traffic volumes detected by said traffic volume detecting means, the traffic flow presuming means including a neural network for determining relationships between traffic volumes and traffic flows, and a first filter means for filtering the traffic flows determined by the neural network;

a presumption function constructing means for constructing and correcting the neural network of said traffic flow presuming means, wherein said presumption function constructing means contains a plurality of relationships between traffic flow patterns and traffic volumes, and constructs said neural network by using arbitrarily selected plural relationships among said relationships, and further corrects said neural network by using newly selected relationships between traffic flow patterns and traffic volumes on the basis of traffic flows presumed from actually measured traffic volumes and controlled results;

a control parameter setting means for setting control parameters for controlling said traffic controllers on the basis of the traffic flow determined by the traffic flow presuming means.

12. The traffic controlling apparatus according to claim 11, wherein said traffic flow presuming means further includes a backup neural network which periodically determines relationships between traffic volumes and traffic flows, and wherein said presumption function constructing means compares and evaluates said neural network and said backup neural network and replaces the contents of said neural network with the contents of said backup neural network when results of said backup neural network are superior to results of said neural network.

13. The traffic controlling apparatus according to claim 11, wherein said traffic flow presuming means further includes a second filtering means complementing said first filtering means.

14. The traffic controlling apparatus according to claim 11, further comprising a control result detecting means for detecting control results and drive results of the transportation system, and wherein said control parameter setting means sets said control parameters based on the control results and the drive results, and said presumption function construction means corrects the presumption function based on the control results and the drive results.

15. The traffic controlling apparatus according to claim 14, wherein said control parameter setting means sets said control parameters by setting standard values of the control parameters in accordance with traffic flows presumed by said traffic flow presuming means, and by executing off-line tuning of the standard values on the basis of control results and drive results detected by said control result detecting means.

16. The traffic controlling apparatus according to claim 14, wherein said control result detecting means detects control results and drive results in real time, and wherein said control parameter setting means sets said control parameters by setting standard values of said control parameters in accordance with traffic flows presumed by said traffic flow presuming means, and by executing on-line tuning of the standard values on the basis of the control results and the drive results detected by said control result detecting means.

17. The traffic controlling apparatus according to claim 14, further including a user interface for outputting control results and drive results detected by said control result detecting means and for setting and correcting said control parameters in response to directions of a user.

18. The traffic controlling apparatus according to claim 11, further comprising a traffic volume estimating means for estimating traffic volumes for prescribed time periods from the traffic volumes detected by said traffic volume detecting means.

19. A traffic controlling apparatus comprising:

a traffic volume detecting means for detecting traffic volumes in a transportation system;

a traffic flow presuming means for presuming traffic flows from the traffic volume detected by said traffic volume detecting means, the traffic flow presuming means including a neural network for determining relationships between traffic volumes and traffic flows, and a backup neural network which periodically determines relationships between traffic volumes and traffic flows;

a presumption function constructing means for constructing and correcting the neural network of said traffic flow presuming means, wherein said presumption function construction means contains a plurality of relationships between traffic flow patterns and traffic volumes, and constructs said neural network by using arbitrarily selected plural relationships among said relationships, and further corrects said neural network by using newly selected relationships between traffic flow patterns and traffic volumes on the basis of traffic flows presumed from actually measured traffic volumes and controlled results, and said presumption function constructing means compares and evaluates results of said neural network and results of said backup neural network and replaces the contents of said neural network with the contents of said backup neural network when the results of said backup neural network are superior to the results of said neural network; and a control parameter setting means for setting control parameters for controlling said transportation system on the basis of the traffic flow determined by the traffic flow presuming means.

20. The traffic controlling apparatus according to claim 19, further comprises a traffic volume estimating means for estimating traffic volumes for prescribed time periods from the traffic volumes detected by said traffic volume detecting means.

21. A method for controlling traffic in a transportation system comprising the steps of:

a) detecting traffic volume in a transportation system;

b) estimating traffic flow from the traffic volume using a presumption function;

c) constructing and correcting the presumption function based on known traffic flow and traffic volume relationships;

d) setting control parameters for controlling the transportation system based upon the estimated traffic flow;

e) detecting control results and drive results of the transportation system; and f) updating the control parameters and the presumption function based upon the control results and the drive results.

22. The method for controlling traffic in a transportation system of claim 21, wherein the presumption function is in the form of a neural network.

23. The method for controlling traffic in a transportation system of claim 22, further comprising the steps of:

periodically determining relationships between traffic volumes and traffic flows in a backup neural network;

comparing results of the backup neural network with results of the neural network;

replacing contents of said neural network with contents of said backup neural network when the results of the backup neural network are superior to the results of said neural network.

24. The method for controlling traffic in a transportation system of claim 21, further comprising the steps of outputting the control results and drive results through a user interface to a user and updating the control parameters based upon inputs from the user through the user interface.

25. The method for controlling traffic in a transportation system of claim 21, further comprising a step of estimating traffic volumes for prescribed time periods from detected traffic volumes.

* * * * *

UNITED STATES PATENT AND TRADEMARK OFFICE

CERTIFICATE OF CORRECTION

PATENT NO. : 5,459,665

DATED : October 17, 1995

INVENTOR(S) : Shiro Hikita, et al

It is certified that error appears in the above-indentified patent and that said Letters Patent is hereby corrected as shown below:

Column 5, line 4, the word "According" starts a new line.
Column 9, line 22, the words "traffic volume date" are changed to -- traffic volume data --.
Column 12, line 31, the expression "$i \div k$" is changed to -- $i \neq k$ --.
Column 12, line 54, the expression "$(yk \div 1)$" is changed to -- $(yk \leq 1)$ --.
Column 12, line 57, the expression "$(yi \div 0, i \pm k)$" is changed to -- $(yi \doteq 0, i \neq k)$ --.
Column 12, line 67, the words "traffic flow estimating" are changed to -- traffic volume estimating --.
Column 13, line 32, the expression "$j \pm k$" is changed to -- $j \neq k$ --.
Column 19, line 55, the expression "(1.5)" is inserted under the block line.
Column 23, line 58, the words "flow estimating means 1A" are changed to -- volume estimating means 1A --.

Signed and Sealed this

Twenty-fifth Day of June, 1996

*Attest:*

Bruce Lehman

BRUCE LEHMAN

*Attesting Officer*

*Commissioner of Patents and Trademarks*